US010458635B2

(12) United States Patent
Sonneman et al.

(10) Patent No.: US 10,458,635 B2
(45) Date of Patent: Oct. 29, 2019

(54) LIGHTING SYSTEM

(71) Applicant: Contemporary Visions, LLC, Larchmont, NY (US)

(72) Inventors: Robert A. Sonneman, Mamaroneck, NY (US); Christian N. Garnett, Mount Kisco, NY (US)

(73) Assignee: Contemporary Visions, LLC, Larchmont, NY (US)

( * ) Notice: Subject to any disclaimer, the term of this patent is extended or adjusted under 35 U.S.C. 154(b) by 0 days.

(21) Appl. No.: 16/201,151

(22) Filed: Nov. 27, 2018

(65) Prior Publication Data

US 2019/0162397 A1 May 30, 2019

Related U.S. Application Data

(60) Provisional application No. 62/591,440, filed on Nov. 28, 2017.

(51) Int. Cl.

| | |
|---|---|
| ***F21V 23/00*** | (2015.01) |
| ***F21V 21/03*** | (2006.01) |
| ***F21V 21/26*** | (2006.01) |
| ***F21S 2/00*** | (2016.01) |
| ***F21V 23/02*** | (2006.01) |

(52) U.S. Cl.

CPC ..... *F21V 23/002* (2013.01); *F21S 2/005* (2013.01); *F21V 21/03* (2013.01); *F21V 21/26* (2013.01); *F21V 23/023* (2013.01)

(58) Field of Classification Search

CPC ..... F21V 23/002; F21V 21/03; F21V 21/26; F21V 23/023; F21S 2/005

USPC ..... 362/249.06

See application file for complete search history.

(56) References Cited

U.S. PATENT DOCUMENTS

| | | | |
|---|---|---|---|
| 2007/0153550 | A1 | 7/2007 | Lehman |
| 2015/0070878 | A1 | 3/2015 | Yu |
| 2015/0198311 | A1 | 7/2015 | O'Brien et al. |
| 2016/0244922 | A1 | 8/2016 | Townsend, Jr. |
| 2017/0198872 | A1 | 7/2017 | Sonneman |
| 2017/0227204 | A1 | 8/2017 | May |

OTHER PUBLICATIONS

International Search Report and Written Opinion From Corresponding PCT Application PCT/US18/62568.

*Primary Examiner* — Anh T Mai
*Assistant Examiner* — Jessica M Apenteng
(74) *Attorney, Agent, or Firm* — Gottlieb, Rackman & Reisman, P.C.

(57) ABSTRACT

A lighting system to be suspended form a ceiling or overhead structure and supported by both electrical cords and additional cables. The lighting system provides a modular system of components that interconnect mechanically and electrically. The lighting system includes a plurality of hubs, including at least one power hub, with each hub including a light element for providing light. The power hub, connecting arms and other hubs cooperate to provide electric current to the light elements from the power source.

20 Claims, 28 Drawing Sheets

LIGHTING SYSTEM

CROSS-REFERENCE TO RELATED APPLICATION

This application claims priority to U.S. Provisional Patent Application No. 62/591,440, filed on Nov. 28, 2017, the contents of which are incorporated herein by reference in its entirety.

FIELD OF THE INVENTION

This invention pertains generally to a lighting fixture or system to be suspended from a ceiling or overhead structure and supported by both electrical cords and additional cables. In particular, an improved lighting fixture that provides a modular system of components that interconnect mechanically and electrically to create unique configurations. The lighting system includes hubs containing light sources that connect to arms, thus providing a design element and lighting source. Each light system contains a power hub that connects the lighting system to a power source and provides electricity to illuminate the light sources.

BACKGROUND OF THE INVENTION

Pendant light fixtures are popular and come in various configurations ranging from small one light units to large multiple light units that are hung from the ceiling. Pendant light fixtures may take the form of one light hanging from one cord to multiple pendant lights hanging from multiple cords. Pendant fixtures are generally chosen based upon the aesthetics of the unit, the amount of lighting desired and the location of where the pendant will be hung. Pendant fixtures are rarely adjustable and allow a user to change the configuration, including the overall design or number of light sources, of the fixture. Therefore, there is a need for a pendant light fixture that is adjustable and allows for multiple configurations.

SUMMARY OF THE INVENTION

In general, the invention pertains to a lighting fixture or system to be suspended from a ceiling or overhead structure and supported by both electrical cords and additional cables. In particular, an improved lighting fixture that includes a modular system of components that interconnect mechanically and electrically to create various unique configurations is provided.

Briefly, a modular lighting system for providing light in a space includes at least one canopy connectable to a power source; at least one power hub that includes two light sources that are connectable to the canopy; and a plurality of connecting arms that mechanically and electrically connect to the power hub and also connect to linear hubs that include light sources and/or forty-five degree power hubs that contain light sources and end arms. The power hub, connecting arms and hubs cooperate to provide electric current to the light sources from the canopy.

It is an object of the present invention to provide a lighting system capable of forming various arrangements containing hubs with light sources that mechanically and electrically attach connecting arms.

It is another object of the present invention to provide a lighting system capable of forming various arrangements containing components, one component being a hub that is connected to a power supply and provides power to all components of the lighting system.

Still other objects of the invention will be apparent from the following description.

DETAILED DESCRIPTION OF THE INVENTION

Figure 1:
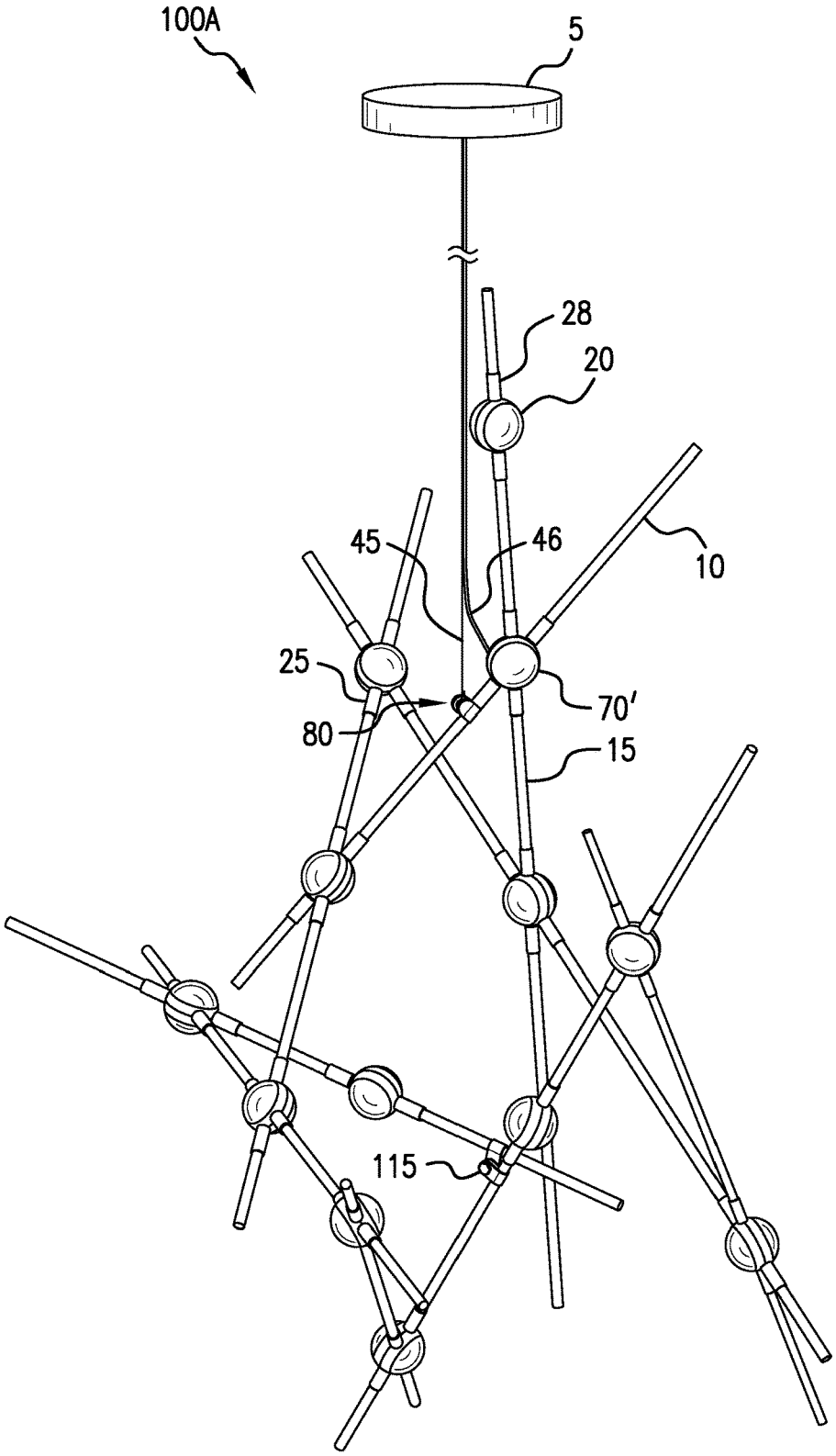
FIG. 1 is a perspective view of a lighting system of the present invention.
Figure 2:
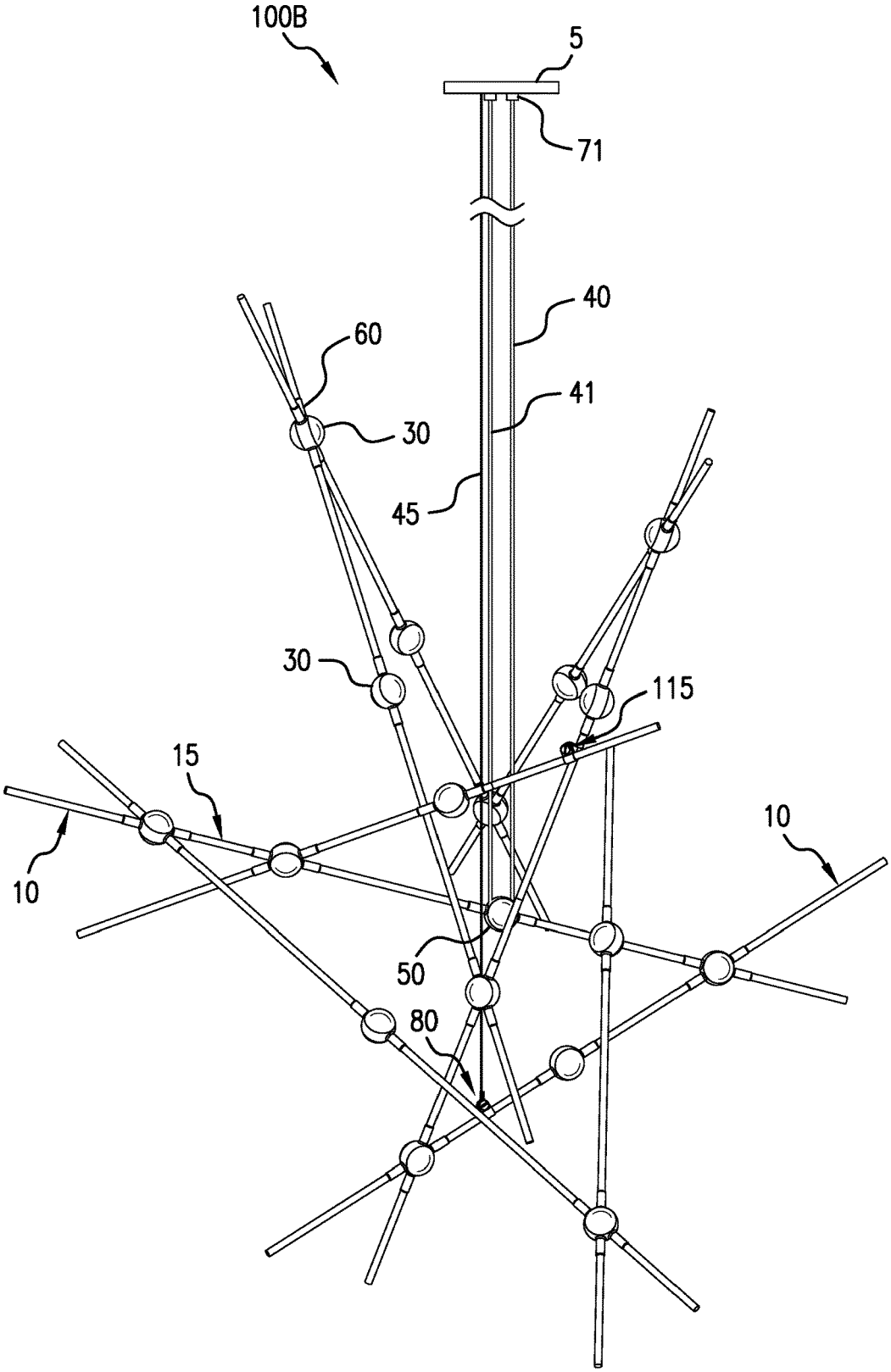
FIG. 2 is a side view of an alternative lighting system of the present invention.
Figure 3A:
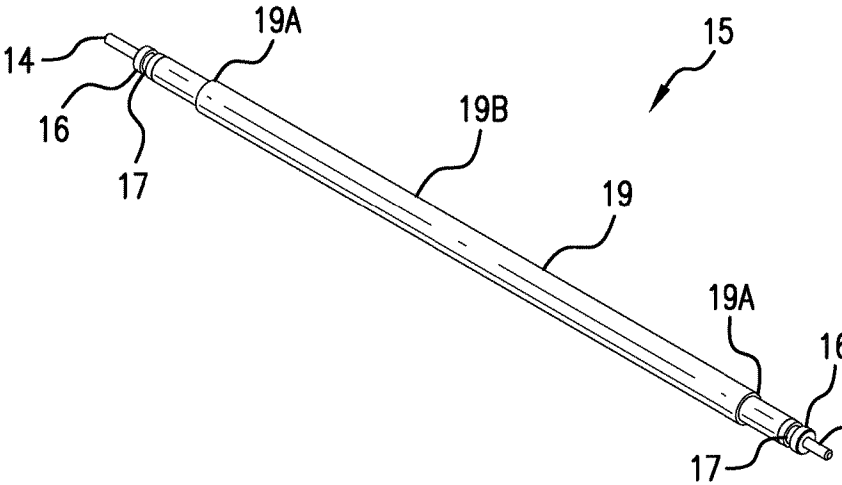
FIG. 3A is a perspective view of a connecting arm of the present invention.
Figure 3B:
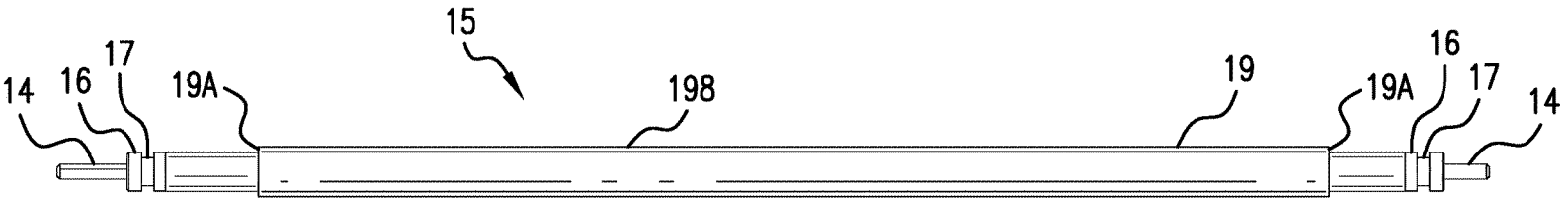
FIG. 3B is a top plan view of the connecting arm of the present invention.
Figure 3C:
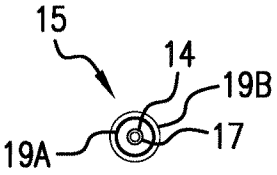
FIG. 3C is a side elevational view of the connecting arm of the present invention.
Figure 4:
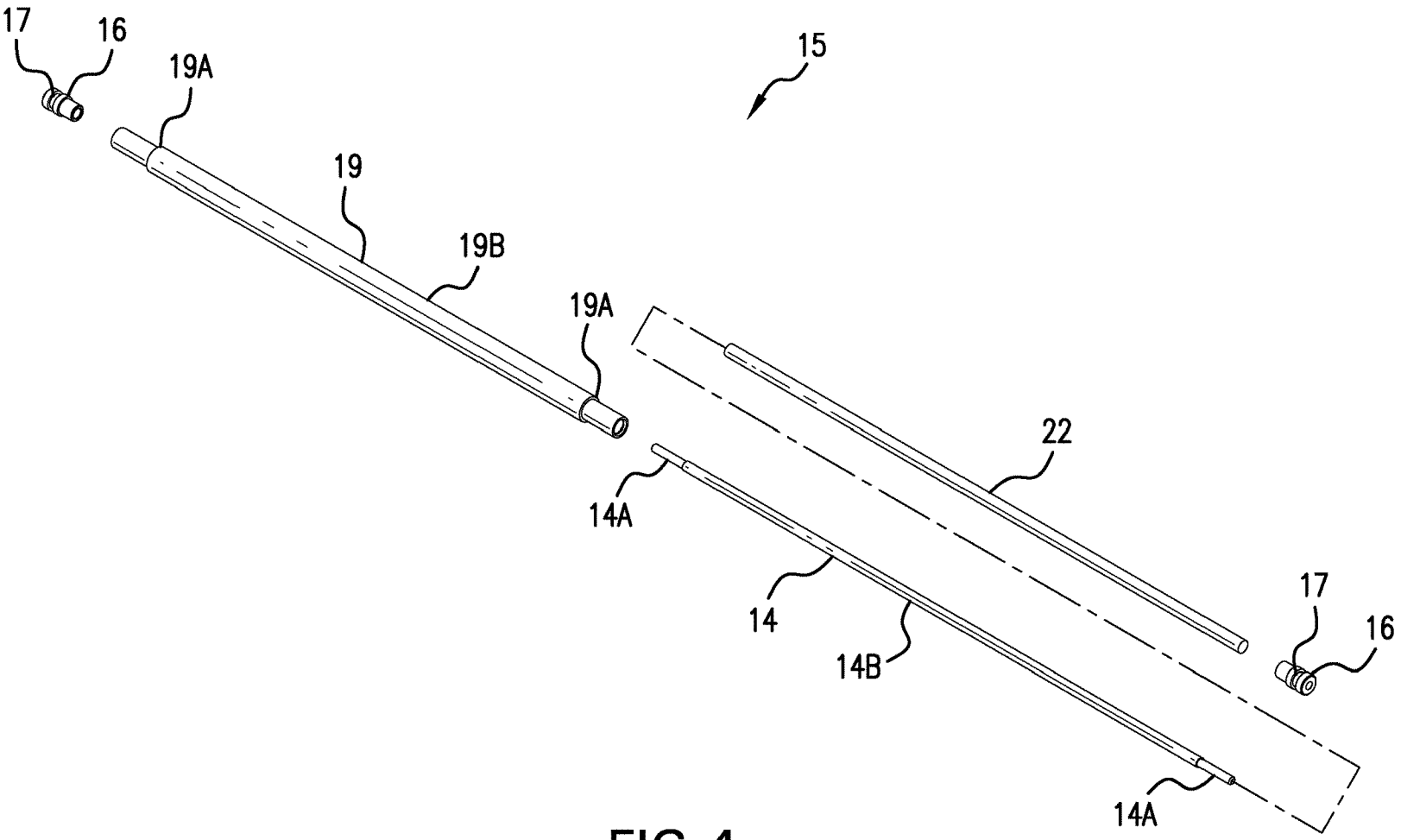
FIG. 4 is an exploded perspective view of the connecting arm of the present invention.
Figure 12A:
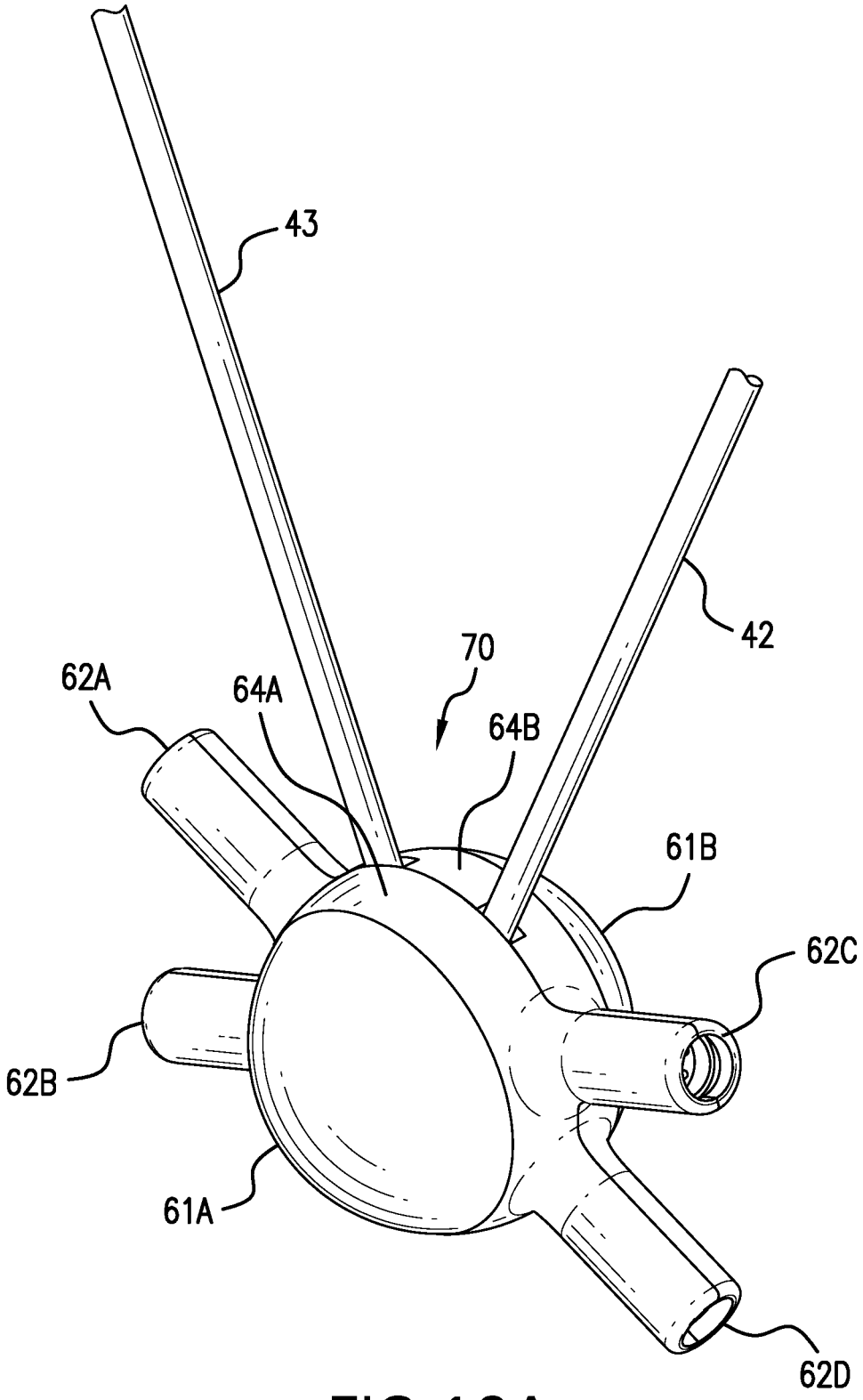
FIG. 12A is a perspective view of a forty-five degree power hub of the present invention.

With reference to the drawings, wherein a reference number indicates the same element throughout, the embodiments of the lighting system of the present invention will be described. The present invention pertains to a modular lighting system having a plurality of interchangeable elements that can be combined in many different arrangements to obtain a large variety of configurations. FIGS. 1-2, show two such system arrangements 100A and 100B. Generally speaking, each arrangement includes one or more canopies 5, at least one linear power hub 50 or forty-five degree power hub 70 (as shown in FIG. 12A), or 70' (see FIG. 12B), a plurality of linear hubs 30, a plurality of forty-five degree hubs 60', a plurality of end arms 10, a plurality of connecting arms 15, and at least one power cord 40 or 46. Each arrangement may also include a mount clip assembly 80 or double mount clip 115.

Figure 17:
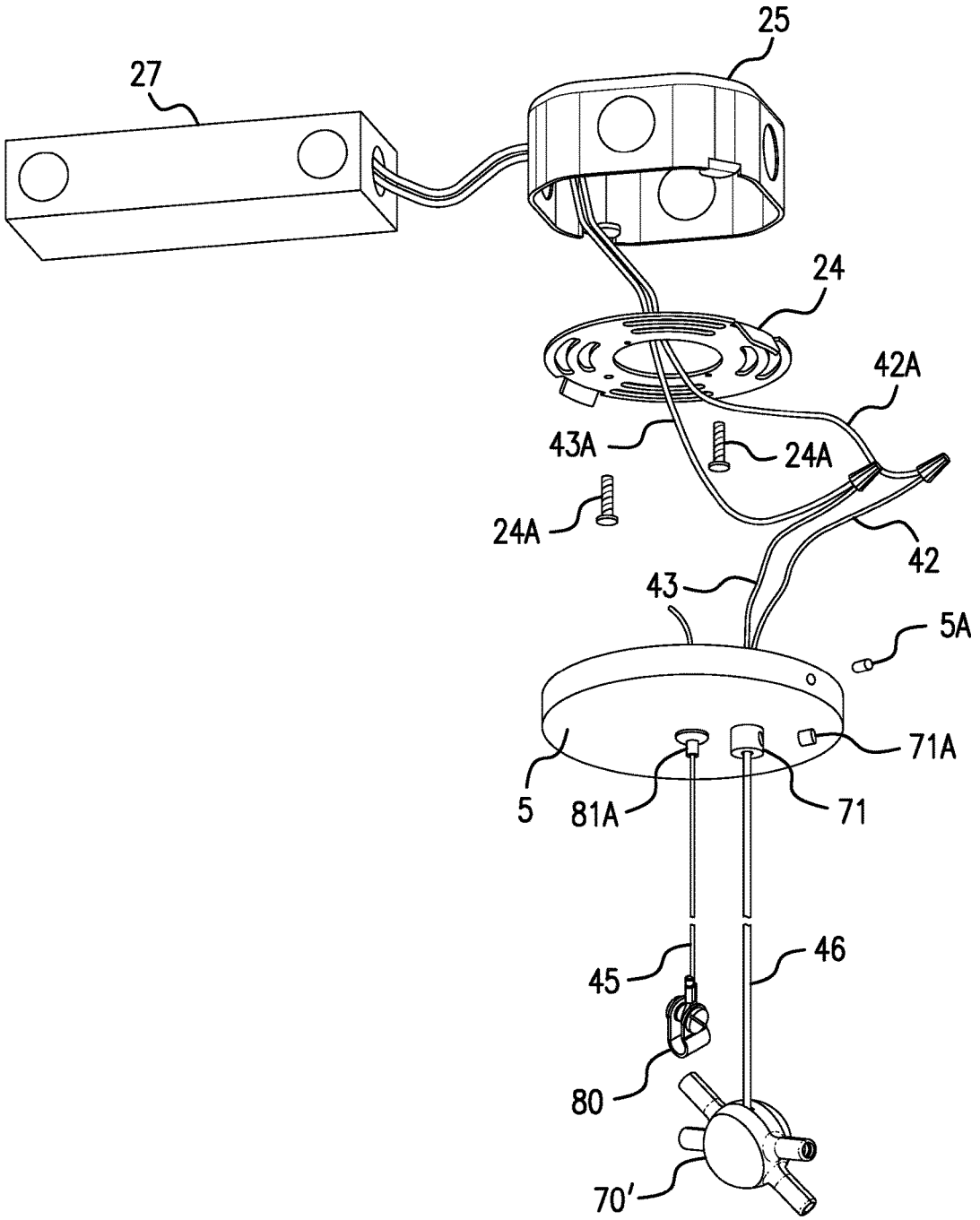
FIG. 17 is an exploded perspective view of the installation of the lighting system of the present invention.

As shown in FIGS. 1 and 17, system arrangement 100A includes a canopy 5 that supports the system from a ceiling or other similar structure in a conventional manner. In this case, the canopy 5 also provides power to the system. Canopy 5 is cooperatively interconnected to a conventional power supply; standard AC lines run from the power supply through canopy 5 for providing power to the light sources in the hubs, as described below. From the canopy 5 extends electrical cord or sleeve 46 that electrically connects to a power hub, as described below, and ceiling hanger 45 that supports a mount clip assembly 80.

As shown in FIG. 1, the lighting system arrangement 100A includes a canopy 5, a first power cord or sleeve 46 extending from the canopy 5 and electrically connected to the forty-five degree power hub 70'. The forty-five degree power hub 70' is connected to an end arm 10 and three connecting arms 15. The connecting arms 15 are connected to one linear hub 30 and three additional forty-five degree hubs 60 and so forth. As is shown components of the inventive system may be selectively added to form a desired configuration or arrangement. At the end of each linear section in the arrangement, the hub is capped by an end arm 10. Each component will be discussed in detail below.

The connecting arm 15 is shown in FIGS. 3A-3C and FIG. 4. The connecting arm 15 comprises a conductor rod 14, an outer arm body 19 an insulating cover 22, and two insulting tips 16. The conductor rod 14 has an elongated body having a first end, a second end and a body section between the first and second end. The first end and second end of the conductor rod 14 may have a shoulder portion 14A, with the diameter of the shoulder portion 14B being less than the diameter of the body section 14A. The insulating cover 22 may be a plastic shrink wrap or other material and is wrapped around the conductor rod 14.

Figure 5A:
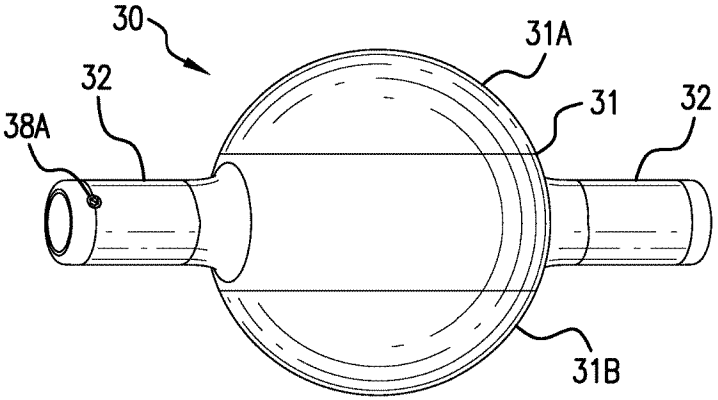
FIG. 5A is a top perspective view of a linear hub of the present invention.
Figure 5B:
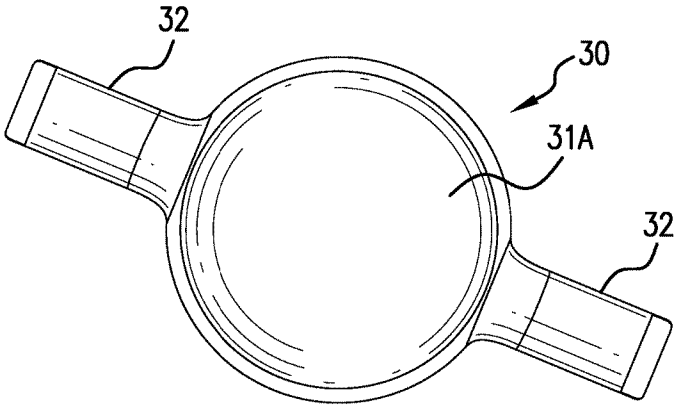
FIG. 5B is a front elevational view of the linear hub of the present invention.
Figure 5C:
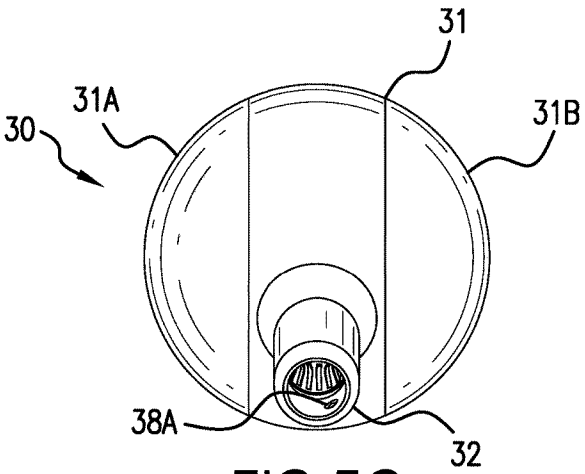
FIG. 5C is a side elevational view of the linear hub of the present invention.
Figure 5D:
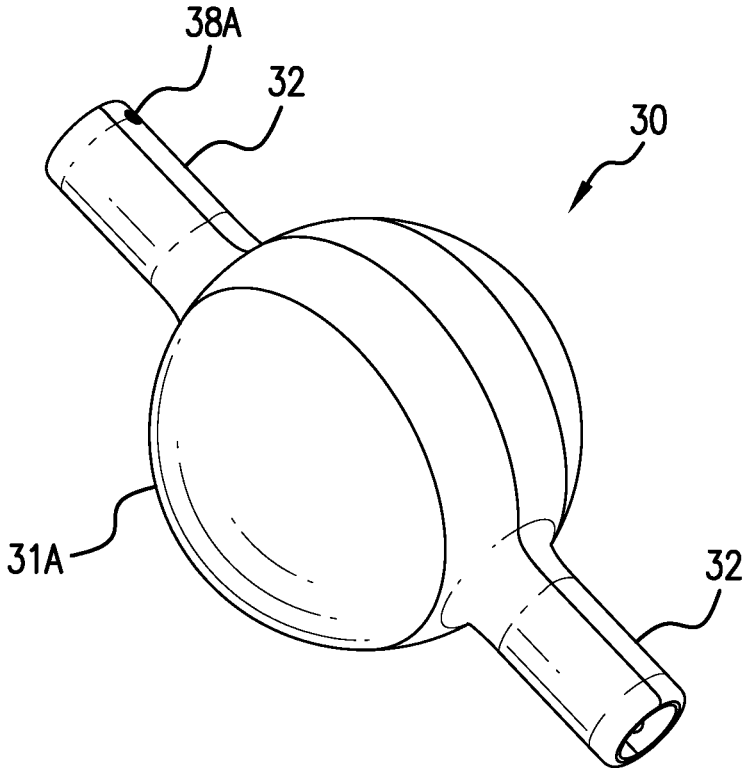
FIG. 5D is a perspective view of the linear hub of the present invention.
Figure 5E:
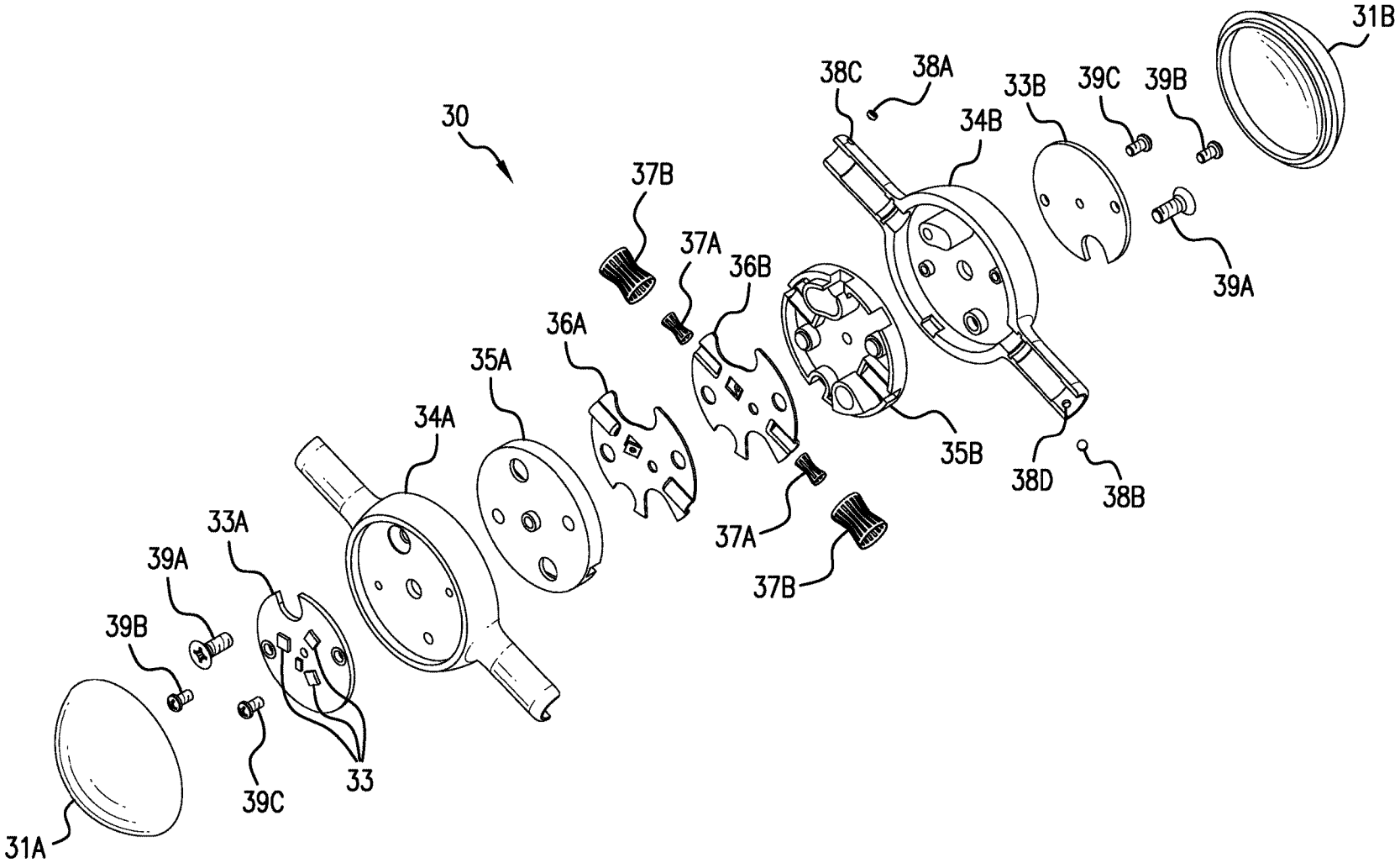
FIG. 5E is an exploded perspective view of the linear hub of the present invention.

The outer arm body 19 has an elongated body having a first end, a second end and a body section 19B that define an internal area. The internal area extends from the first end to the second end and is sized to accept the conductor rod 14 and insulting cover 22 therein. The first end and second end may have a shoulder portion 19A where the diameter of the shoulder portion 19A is less than the diameter of the body section 19B. It is contemplated that the outer arm body 19 may not have a shoulder portion and is one diameter from the first end to the second end. The insulting tips 16 are sized to mate with the first end and second end of the outer arm body 19. The insulting tips comprise an annular aperture, recess or slot 17 capable of accepting a set screw 38A, 38B (such as shown in FIG. 5E) or other attachment means to secure the connecting rod 15 to a hub of the present invention, as described later on.

The conductor rod 14 is concentrically nested in the outer arm body 19. The conductor rod 14 is longer than the outer arm body 19 so the first end and the second end of the conductor rod 14 extend out of the outer arm body 19. The first insulating tip 16 slides over the first end of the conductor rod 14 and screws into the first end of the outer arm body 19. The second insulting tip 16 slides over the second end of the conductor rod 14 and screws into the second end of the outer arm body 19. The first and second insulating tips 16 may connect to the outer arm body 19 by any means known by those skilled in the art, such as a snap fit, glue or groove system.

In the preferred embodiment, the connecting arm 15 is cylindrical. It is contemplated that the connecting arm may have different cross-sectional shapes such as rectangular, square or other polygons.

The connecting arm 15 is used to mechanically and electrically connect two hubs together. The outer arm body 19 is a metal conductor tube and carries negative (−) current. The inner conductor rod 14 carries positive (+) current. The insulating cover 22 acts as a barrier between the outer arm body 19 and the conductor rod 14 to prevent electrical contact between them. The insulating tips 16 of the connecting arm 15 act to mechanically connect the connecting arm 15 to a hub. Each insulting tip 16 contains an interlocking feature that is capable of engaging and mating with an interlocking feature on the hubs, as described below. Once the hub and connecting arm 15 are joined, positive (+) and negative (−) electrical current can pass through the connecting arm 15 from one hub to another hub. A series of connecting arms 15 and hubs can be joined. The connecting arms 15 may vary in size in order to obtain different configurations as desired. The connecting arm can vary in length and be 4¼", 3¼", 2½, etc.

FIGS. 5A-5D show a linear hub 30 of the invention. The linear hub 30 comprises a substantially spherical body 31, having a first side and a second side, and two arm mounts 32. The construction of the first side and second side of the linear hub 30 preferably mirror each other.

It is contemplated that the body of the linear hub 30 may be of different shapes and sizes.

FIG. 5E shows the inner construction of the linear hub 30. The linear hub 30 comprises a first and second diffusers 31A, 31B; first and second light sources 33A, 33B, first and second body components 34A, 34B, first and second insulators 35A, 35B, first and second conductor plates 36A, 36B, first and second spring contacts 37A, 37B and attachment means such as screws 39A, 39B, 39C.

The first and second spring contacts 37A nest within the first and second conductor plates 36A and 36B which secures the spring contacts 37A in place. The first and second insulators 35A and 35B sandwich the first and second conductor plates 36A, 36B. The first and second body components 34A, 34B connect together in order to house the first and second conductor plates 36A, 36B and first and second insulators 35A, 35B therein. When the first and second body components 34A, 34B are joined, the first and second arm mounts 32 are formed. The arm mounts 32 extend from each side of the central spherical body 31. Each arm mount 32 houses and secures the spring contacts 37B therein. Each arm mount 32 has a recess 38C, 38D that is used to secure the linear hub 30 to the slot 17 in the connecting arms 15, as described herein.

The outside of the first and second body components 34A and 34B house the first and second light sources 33A, 33B. Attachment means 39A, 39B, 39C are used to secure the first and second body components 34A, 34B together and extend through openings in the first and second light sources 33A, 33B, the first and second body components 34A, 34B, first and second insulators 35A, 35B and first and second conductor plates 36A, 36B. It is preferred the attachment means 39A, 39B, 39C are screws, as stated before.

Figure 9A:
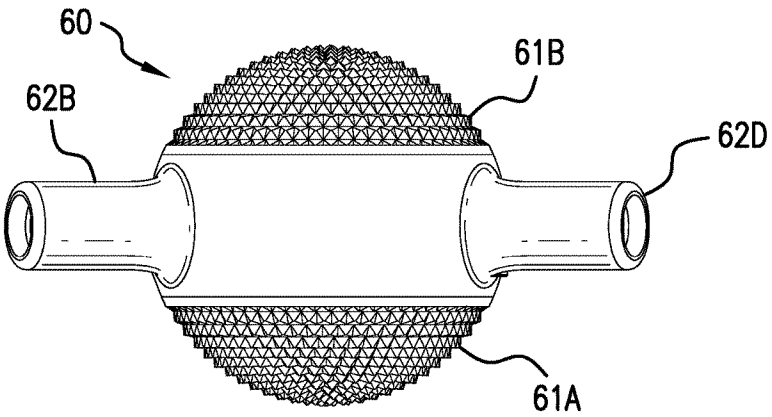
FIG. 9A is a top plan view of a forty-five degree hub of the present invention.
Figure 9C:
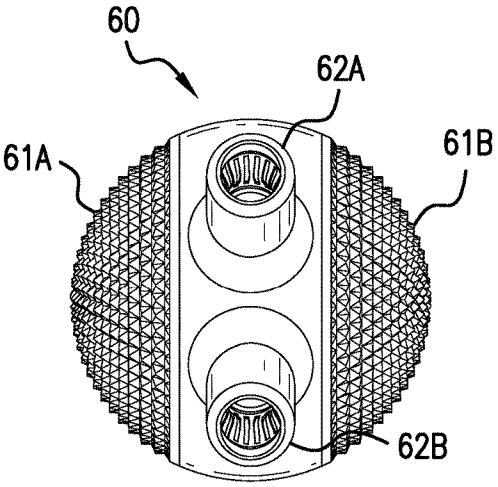
FIG. 9C is a right side elevational view of the forty-five degree hub of the present invention.
Figure 9B:
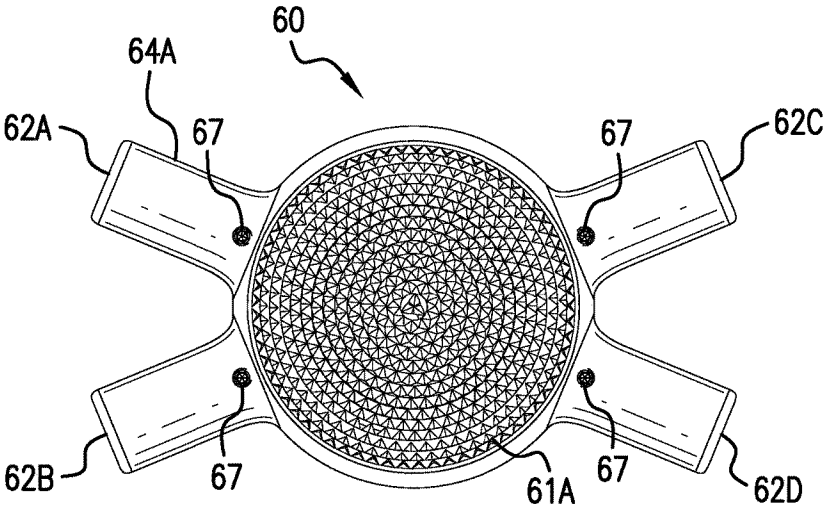
FIG. 9B is a front elevational view of the forty-five degree hub of the present invention.

The first and second light sources 33A, 33B are enclosed by a first and second diffusers 31A, 31B. The first and second diffusers 31A, 31B are attached to the first and second body components 36A, 36B by a snap fit or other means known by those skilled in the art. The first and second diffusers 31A, 31B are preferably made of plastic such as acrylic or another material that allows the light produced by the first and second light sources 33A, 33B to illuminate therethrough. As shown in FIGS. 9A, 9B and 9C, the first and second diffusers 31A, 31B of any hub may be made from clear faceted acrylic. Alternatively, the first and second diffusers 31A, 31B may be constructed of a white optical acrylic, as shown in FIG. 5E.

As shown in FIG. 5E, the first and second light sources 33A, 33B contain lights 33 which are preferably light emitting diodes (LEDs). The first and second insulators 35A, 35B are preferably made of plastic. The first and second conductor plates 36A, 36B are preferably made of metal. The first and second body components 34A, 34B are preferably made from metal.

Figure 6A:
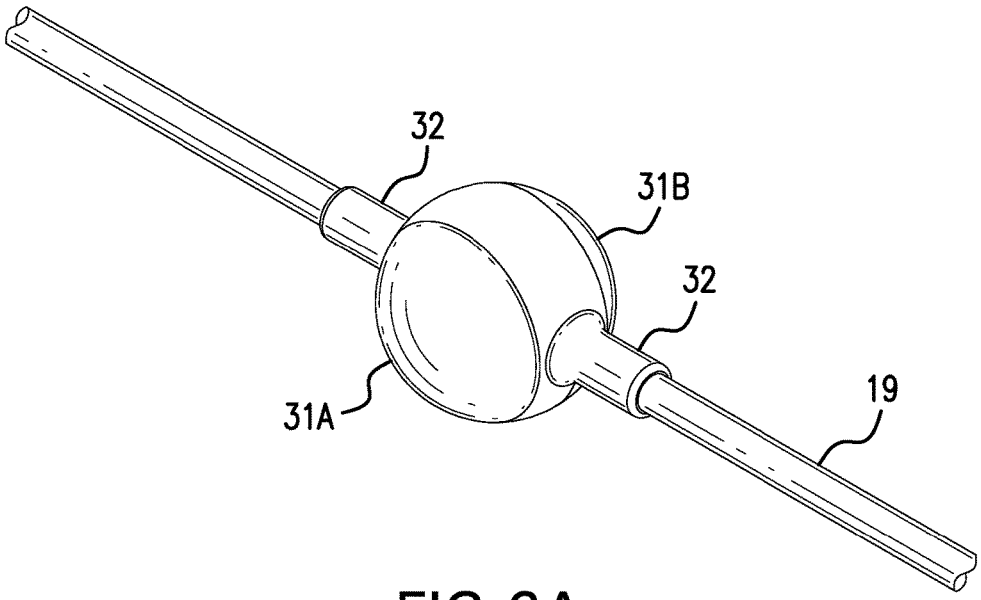
FIG. 6A is a perspective view of the linear hub attached to a pair of connecting arms of the present invention.
Figure 6B:
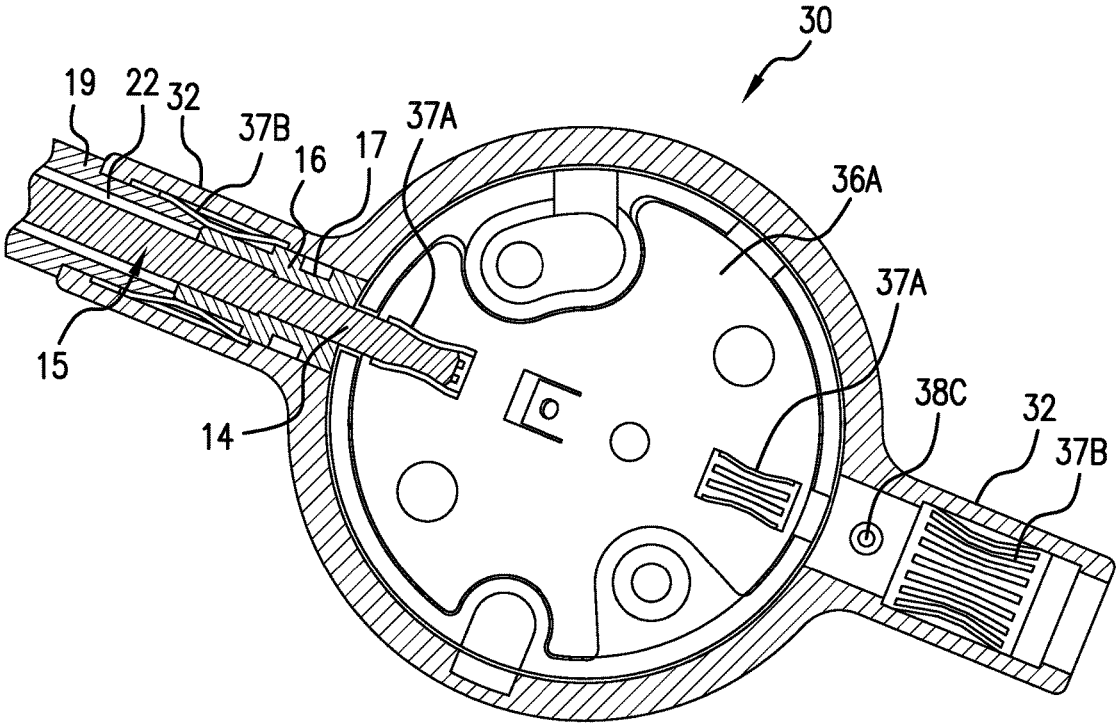
FIG. 6B is an enlarged side cross-sectional view of the linear hub attached to one connecting arm of the present invention.
Figure 6C:
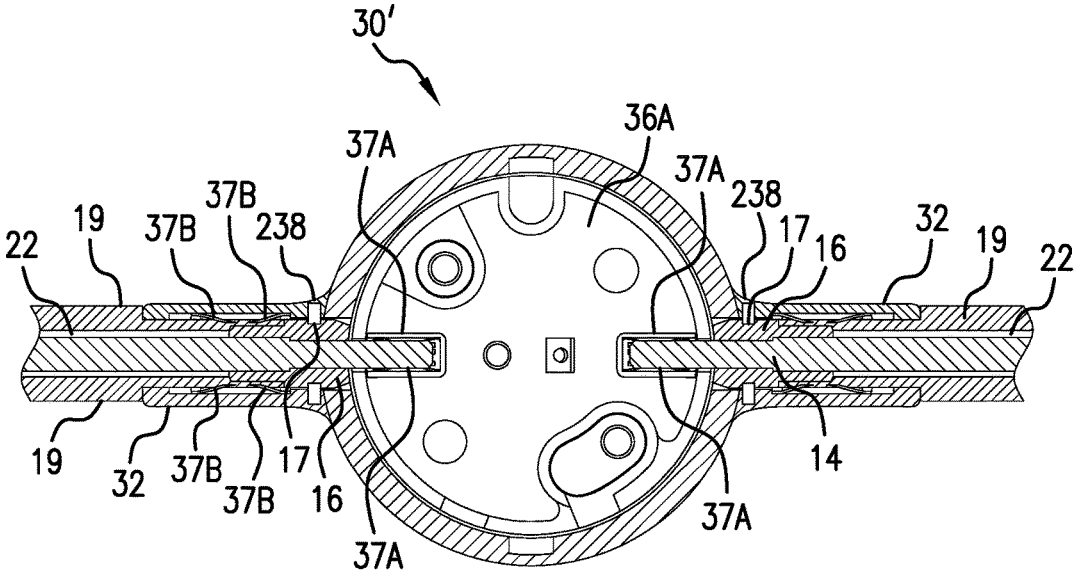
FIG. 6C is an enlarged side cross-sectional view of an alternative linear hub attached to two connecting arms of the present invention.

As shown in FIGS. 6A, 6B and 6C, the arm mounts 32 of the linear hub 30 are capable of accepting the first or second end of the connecting arm 15 and locking it in place. As shown in FIG. 6B, when the connecting arm 15 is inserted into the arm mount 32 of the linear hub 30, a set screw 38A, 38B (shown in FIG. 5E) is disposed through the respective recess 38C, 38D in the end of each arm mount 32 in order to engage with the slot 17 in the insulting tip 16 of the connecting arm 15. An alternative embodiment of the linear hub of the present invention is shown in FIG. 6C, where the construction of the linear hub 30' is identical except that a spring clip 238 secures the connecting arm 15 to the linear hub 30 instead of a set screw.

As shown in FIGS. 6A and 6B, as well as FIG. 6C, when a connecting arm 15 is inserted into one of the arm mounts 32 of hub 30 or hub 30', two electrical contacts are made. The first contact is between the conductor rod 14 and the conductor spring contacts 37A. To make the first connection, the first or second end of the conductor rod 14 of the connecting arm 15 is inserted into the selected arm mounts 32 of the hub 30 and into the corresponding spring contact 37A which sits within and between the first and second conductor plates 36A, 36B (also shown in FIG. 5E). Positive current is conducted from conductor rod 14 in the connecting arm 15 through the spring contact 37A and into the conductor plates 36A, 36B. The conductor plates 36A, 36B hold and carry the current throughout the hub and allow the current to transfer to a conductor rod 14 of a second connecting arm 15 inserted into the arm mount 32 of the hub 30, that makes contact with the arm corresponding spring contact 37A. The second electrical contact is between the outer arm body 19 of connecting arm 15 and the second spring contact 37B. When the connecting arm 15 is inserted into the arm mount 32 of the hub, the outer arm body 19 is inserted into and within the second spring contact 37B that sits within the arm mount 32. Negative current is conducted from the outer arm body 19 of the connecting arm 15 to the spring contact 37B and into the hub through the first and second body components 34A, 34B. The first and second body components 34A, 34B are conductive and hold and carry the current throughout the hub and allow the current to transfer to the arm body 19 of a second connecting arm 15 inserted into the other arm mount 32 of the hub 30' that makes contact with the corresponding second spring contact 37B. As described, when a connecting arm 15 is electrically connected to a linear hub of ether design shown in FIG. 6B or FIG. 6C, or connected to other hubs of the present invention, electricity is capable of traveling from each hub through the connecting arms 15 to other hubs throughout the arrangement in a similar fashion.

FIGS. 7A-7D show an alternative hub of the present invention, namely a linear power hub 50. The construction of the linear power hub 50 is identical to the linear hub 30; however it also allows electrical current to travel from a power source above the canopy 5 (see FIG. 17) through a first power cord 41 and a second power cord 40 and into the hub 50. The first power cord 41 and second power cord 40 enter the hub 50 through openings 34C, 34D formed in the top of linear power hub 50 when the first and second body components 34A', 34B' are mated together. In an alternative embodiment, the linear power hub 50 comprises only one power cord that enters the linear power hub 50 through a single substantially central opening formed in the top of the linear power hub when the first and second body components are mated together (not shown).

Figure 7B:
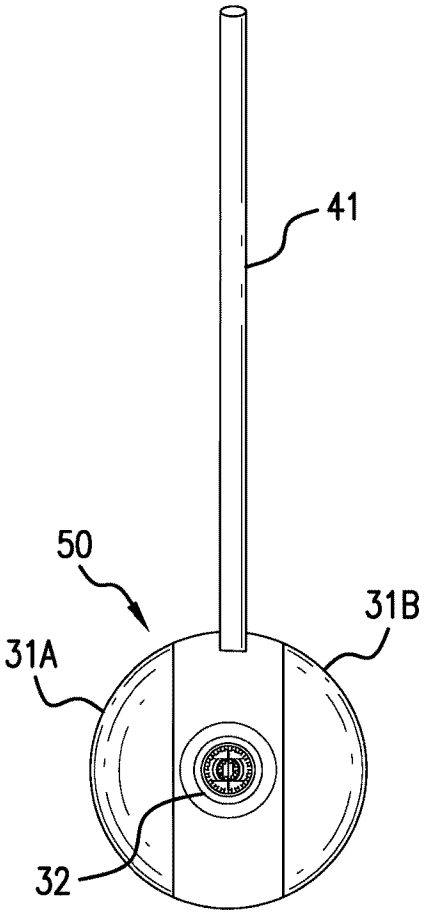
FIG. 7B is a side elevational view of the linear power hub of the present invention.
Figure 7A:
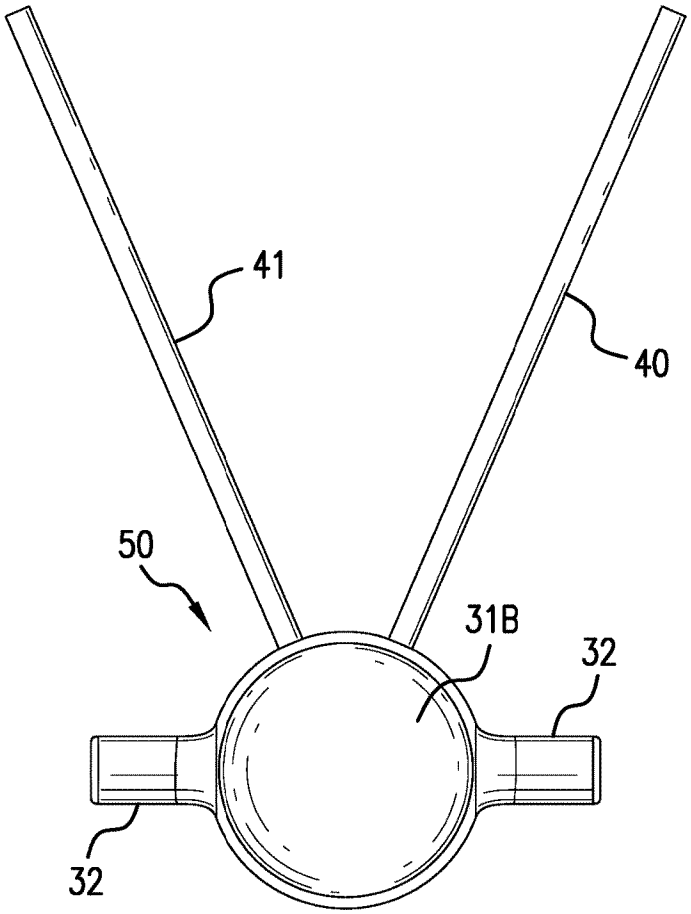
FIG. 7A is front elevational view of a linear power hub of the present invention.
Figure 7C:
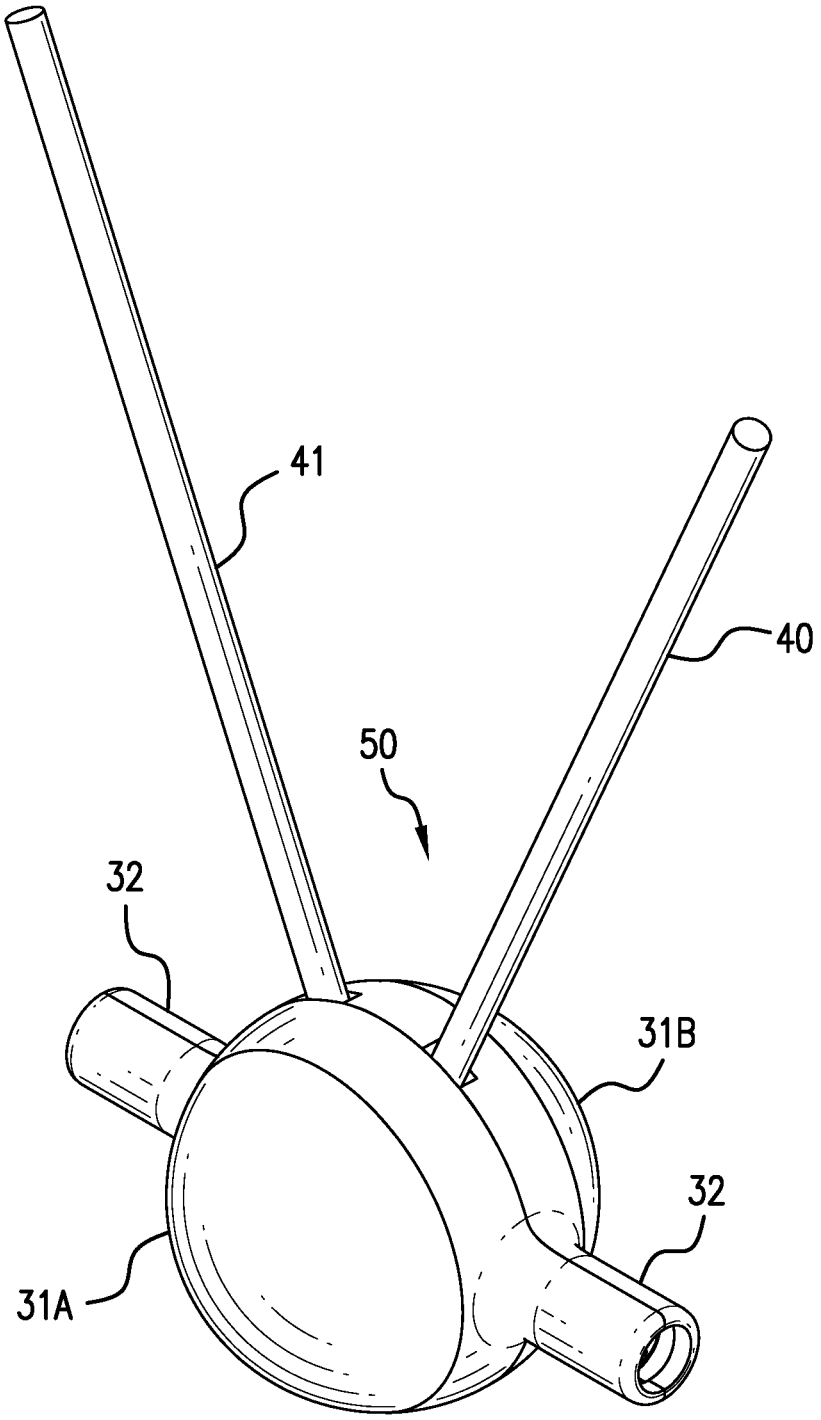
FIG. 7C is a perspective view of the linear power hub of the present invention.
Figure 7D:
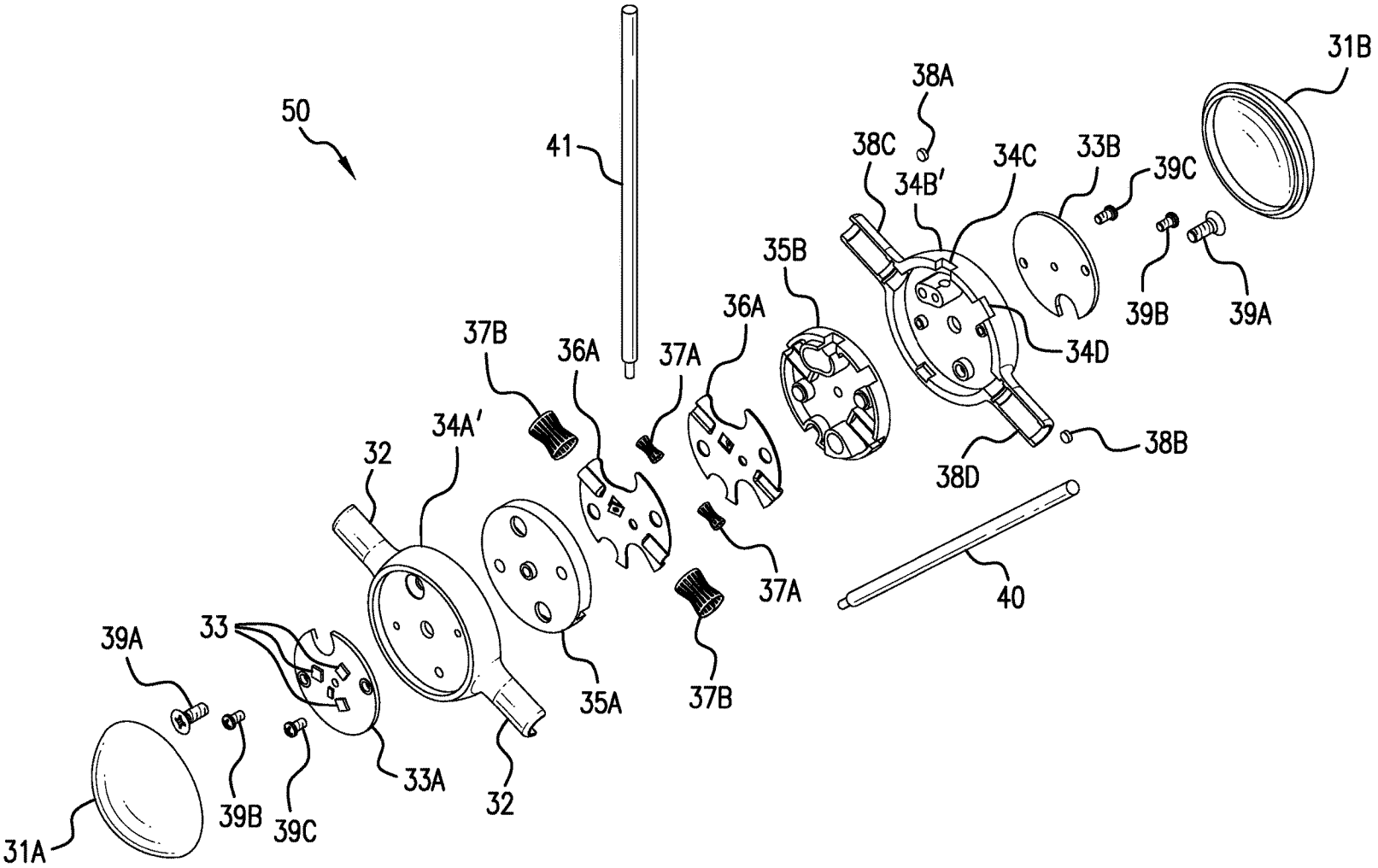
FIG. 7D is an exploded perspective view of the linear power hub of the present invention.
Figure 8B:
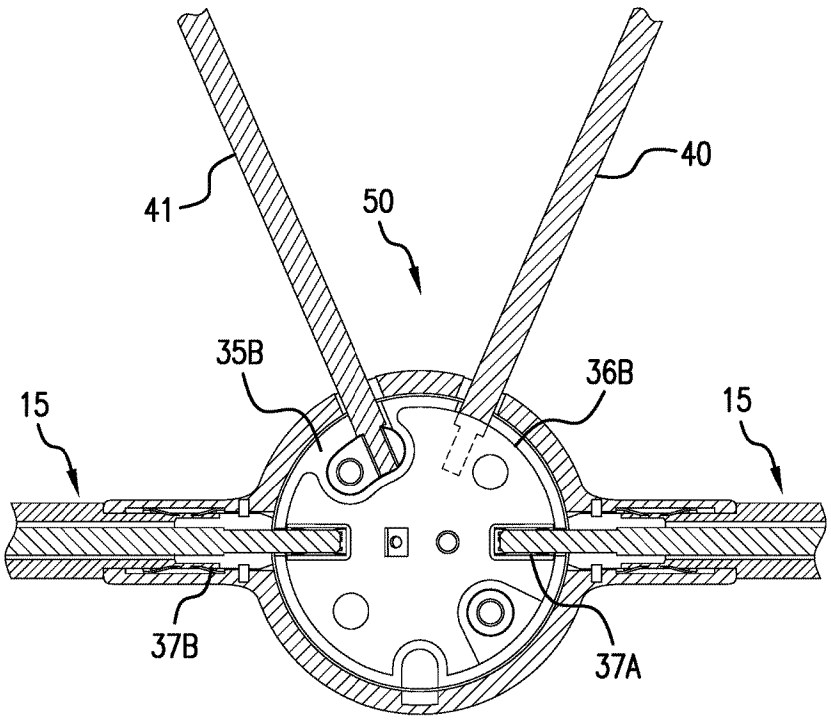
FIG. 8B is an enlarged side cross-sectional view of the linear power hub attached to two connecting arms of the present invention.
Figure 8A:
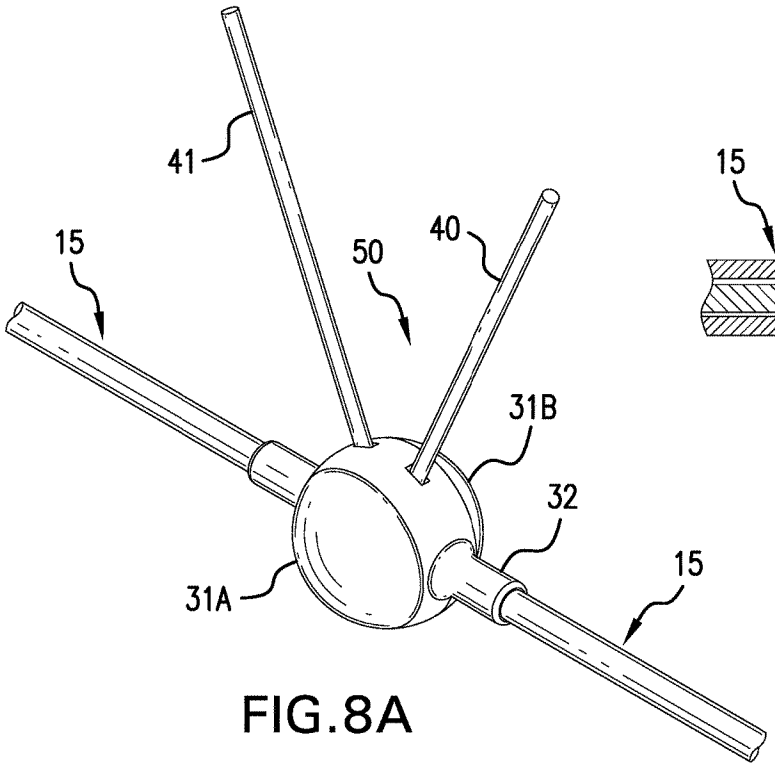
FIG. 8A is a perspective view of the linear power hub attached to two connecting arms of the present invention.

As shown in FIGS. 8A and 8B, the first power cord 41 supplies negative (−) current to the linear power hub 50. The first power cord 41 enters the top of the linear power hub 50 and connects to the first insulator 35B to make an electrical connection with the first and second body components 34A', 34B' (shown in FIG. 7D) of the linear power hub 50. The second power input cord 40 supplies positive (+) power to the linear power hub 50. The second power input cord 40 enters the top of the linear power hub 50 and connects to the first and second conductor plates 36A, 36B (shown in FIG. 7D) to make an electrical connection with the linear power hub 50. Once the first and second power input cords 40, 41 are connected to a power supply, electricity travels into the linear hub 50 and illuminates the lights 33 of the first and second light sources 33A, 33B (as shown in FIG. 7D). Additional hubs, such as a linear hub, can be added to the lighting system arrangement by attaching additional connecting arms 15. Once installed, the linear power hub 50 will supply current through the connecting arms 15 to the additional hubs in order to illuminate the lights 33 of light sources 33A, 33B.

FIGS. 9A-10C show an alternative hub of the present invention, a forty-five degree hub 60. The construction of the forty-five degree hub 60 is similar to that of the linear hub 30 (see FIGS. 5A-5E) with the forty-five degree hub comprising a body 61 and first, second, third and fourth arm mounts 62A, 62B, 62C, 62D. The arm mounts 62A-62D extend from the hub body, the first and second arm mounts 62A, 62B extending outwardly on one side of the forty-five degree hub at approximately 45 degrees from each other, and the third and fourth arm mounts 62C, 62D extending outwardly on the other side of the forty-five degree hub at approximately 45 degrees from each other.

It is contemplated that the body of the forty-five degree hub 60 can be designed to have different shapes and sizes.

Figure 10A:
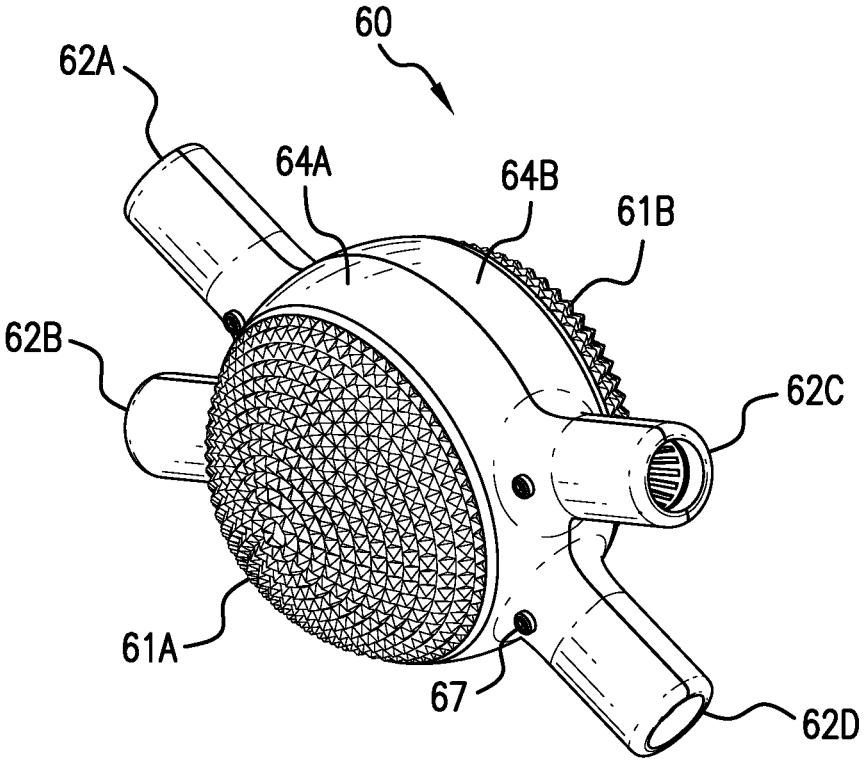
FIG. 10A is a perspective view of the forty-five degree hub of the present invention.
Figure 10B:
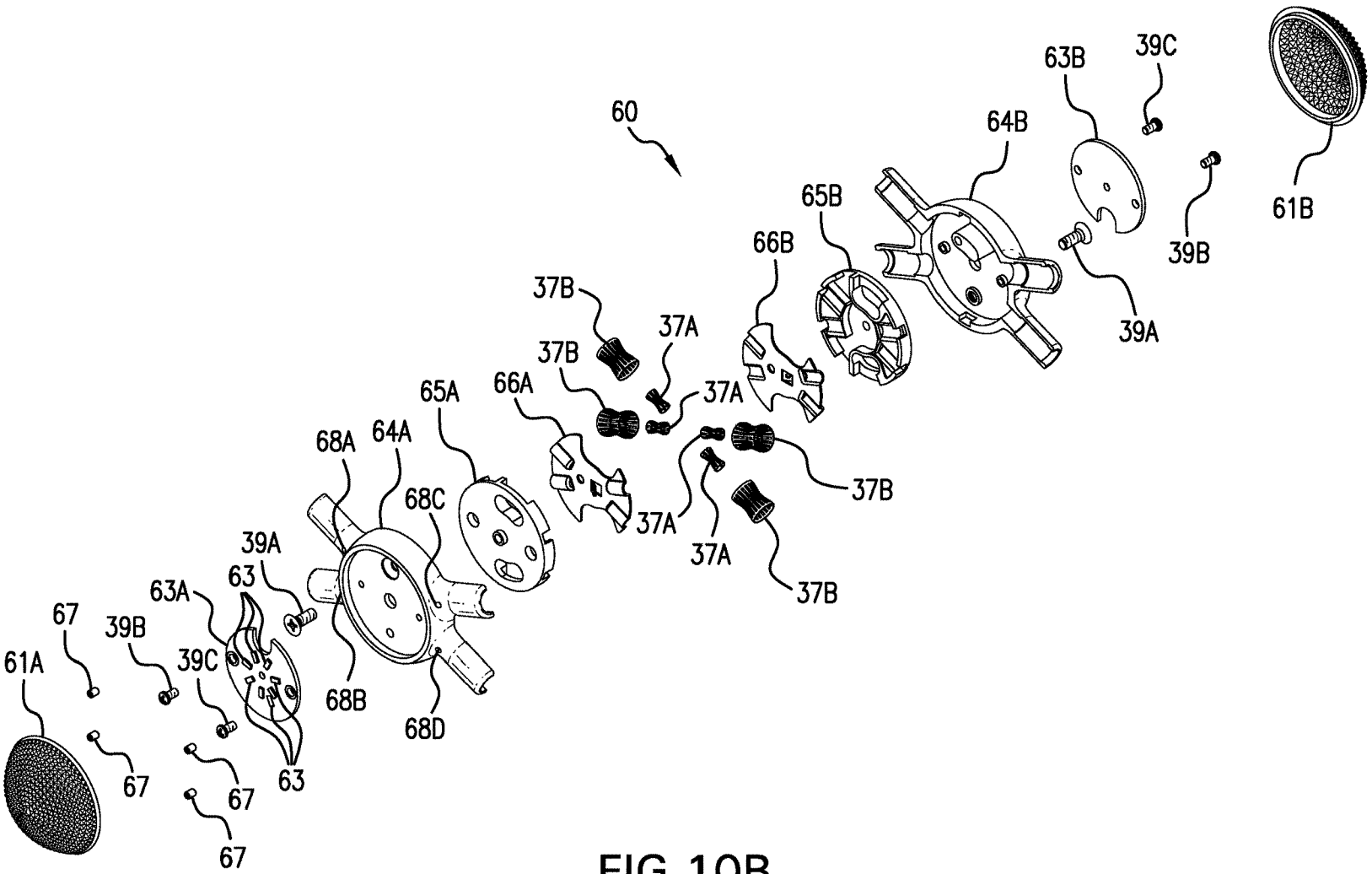
FIG. 10B is an exploded perspective view of the forty-five degree hub of the present invention.

FIG. 10B shows the inner construction of the forty-five degree hub 60 similar to linear hub 30. The forty-five degree hub 60 comprises first and second diffusers 61A, 61B; first and second light sources 63A, 63B, first and second body components 64A, 64B, first and second insulators 65A, 65B, first conductor spring contacts 37A, second conductor spring contacts 37B and attachment means such as screws 39A, 39B, 39C.

Figure 11A:
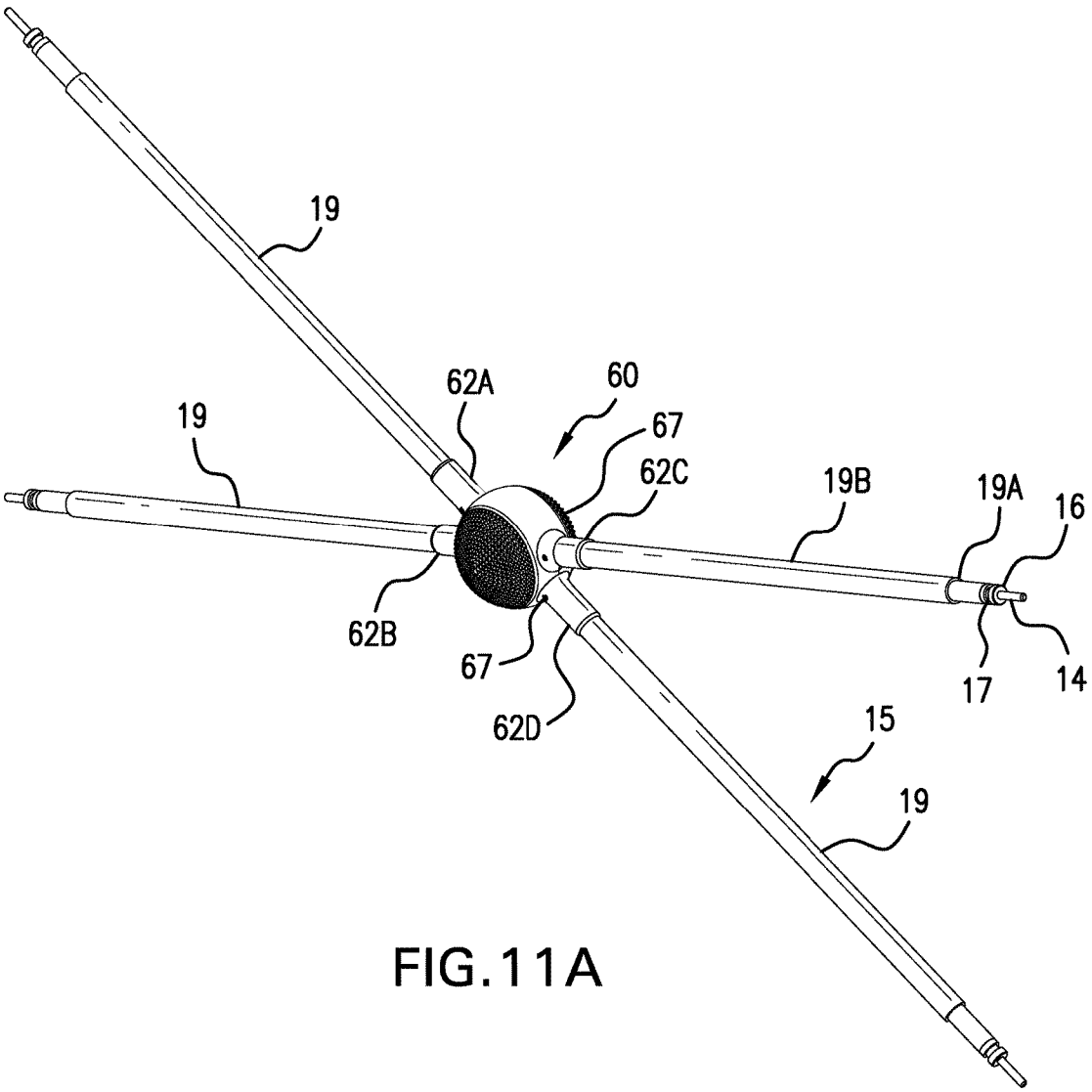
FIG. 11A is a perspective view of the forty-five degree hub attached to four connecting arms of the present invention.
Figure 11B:
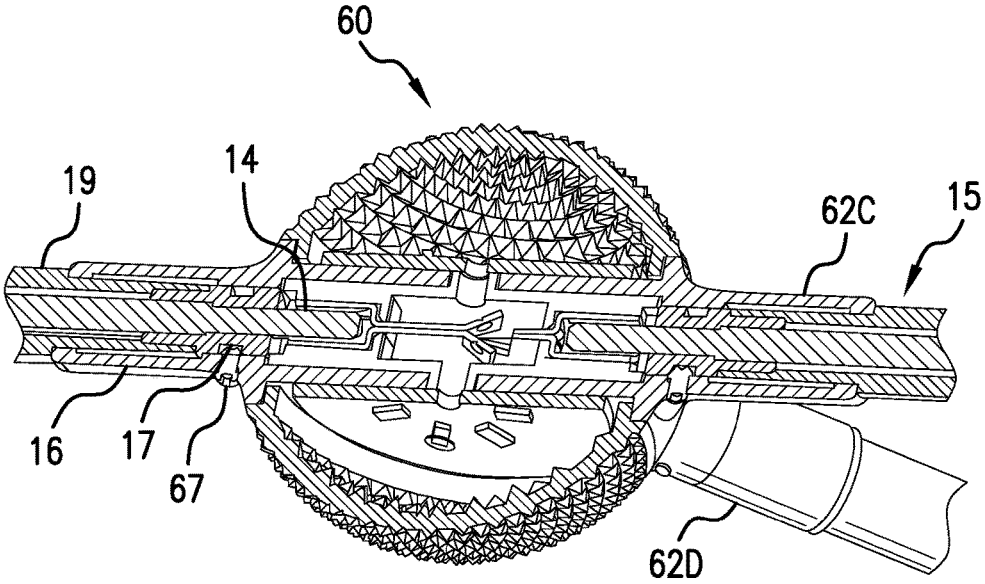
FIG. 11B is a perspective cutout view of the forty-five degree hub attached to four connecting arms of the present invention.
Figure 11C:
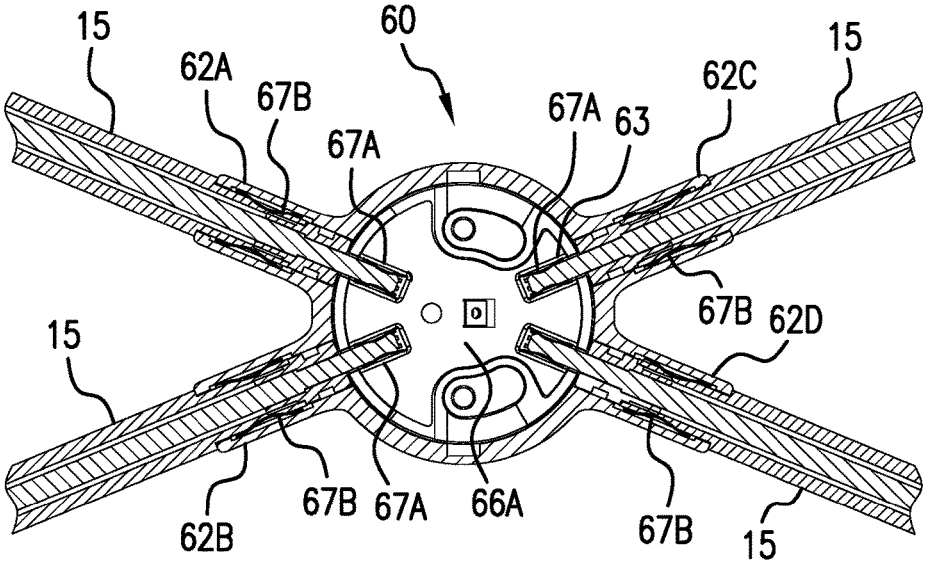
FIG. 11C is an enlarged side cross-sectional view of the forty-five degree hub attached to four connecting arms of the present invention.

As shown in FIGS. 10B, 11B and 11C, the first spring contacts 37A nest within the first and second conductor plates 66A and 66B which secures the springs 37A in place. The first and second insulators 65A and 65B sandwich the first and second conductor plates 66A, 66B. The first and second body components 64A, 64B connect together in order to house the first and second conductor plates 66A, 66B and the first and second insulators 65A, 65B therein. When the first and second body components 64A, 64B are joined, the first, second, third and fourth arm mounts 62A-62D are formed. The first and second arm mounts 62A, 62B extend from one side of the spherical body 61. The first arm mount 62A extends at a 45 degree angle to the second arm mount 62B. The third and fourth arm mounts 62C, 62D extend from the second side of the spherical body 61. The third arm mount 62C extends at a 45 degree angle to the fourth arm mount 62D. Each arm mount 62A, 62B, 62C, 62D houses and secures a spring contact 37B therein. Each arm mount 62A, 62B, 62C, 62D has a corresponding recess 68A, 68B, 68C, 68D through which a set screw 67 is used to engage slot 17 in order to secure the forty-five degree hub 60 to a connecting arm.

As shown in FIG. 10B, the outside of the first and second body components 64A and 64B house the first and second light sources 63A, 63B. The first and second light sources 63A, 63B comprise lights 63 such as LEDs. Attachment means 39A, 39B, 39C are used to secure the first and second body components 64A, 64B together and extend through the first and second light sources 63A, 63B, the first and second body components 64A, 64B, first and second insulators 65A, 65B and first and second conductor plates 66A, 66B. As set forth above, it is preferred the attachment means 39A, 39B, 39C are screws.

Similarly to the linear hub 30, in the forty-five degree hub 60, the first and second light sources 63A, 63B are enclosed by a first and second diffuser 61A, 61B. The first and second diffusers 61A, 61B are attached to the first and second body components 66A, 66B by a snap fit or other means known by those skilled in the art. The first and second diffusers 61A, 61B are preferably made of plastic such as acrylic or another material that allows the light produced by the first and second light sources 33A, 33B to shine therethrough. As shown in FIGS. 9A, 9B and 9C, the first and second diffusers 61A, 61B are constructed from clear faceted acrylic. Alternatively, a white optical acrylic design may be used. It is contemplated that the diffusers 61A, 61B be constructed from different materials.

Similarly to the linear power hub 30, the first and second insulators 65A, 65B are preferably made of plastic; the first and second conductor plates 66A, 66B are preferably made of metal and the first and second body components 64A, 64B are preferably made from metal.

As shown in FIGS. 11A, 11B and 11C, the arm mounts 62A-62D are capable of attaching to the connecting arms 15 in the same way that the linear hub 30 attaches to the connecting arms 15. The arm mounts 62A-62D of the forty-five degree hub 60 are capable of accepting the first or second end of the connecting arm 15 and locking it in place. As shown in FIGS. 11B and 11C, when the connecting arm 15 is inserted into any arm mount 62A-62D of the forty-five degree hub 60, set screws 67 (shown in FIG. 10B) are disposed through respective recess 68A, 68B, 68C, 68D in the end of each arm mount 62A-62D in order to engage slot 17 formed in the insulting tip 16 of the connecting arm 15. In an alternative embodiment of the present invention, the construction of the forty-five degree hub 60 is identical except that a spring clip secures the connecting arm 15 to the forty-five degree hub 60 instead of a set screw.

As shown in FIGS. 11A, 11B and 11C, when the connecting arm 15 is inserted into the arm mounts 62A-62D, two electrical contacts are made. This functions the same as the contacts between the connecting arm 15 and the linear hub 30. The first contact is between the conductor rod 14 and the conductor spring contacts 67A. To make the first connection, the first or second end of the conductor rod 14 of the connecting arm 15 is inserted into one of arm mounts 62A-62D of the hub 60 and into and within the conductor spring contact 67A, which sits within the first and second conductor plates 66A, 66B (shown in FIG. 10B). Positive current is conducted from conductor rod 14 in the connecting arm 15 through the spring contact 67A and into the conductor plates 66A, 36B. The second electrical contact is between the outer arm body 19 and the second spring contact 67B. When the connecting arm 15 is inserted into an arm mount 62A-62D of the hub 60, the outer arm body 19 is inserted into and within the second conductor spring contact 67B that sits within an arm mount 62A-62D. Negative current is conducted from the outer arm body 19 of the connecting arm 15 to the spring contact 67B and into the hub 60. As described, when the connecting arm 15 is electrically connected to the forty-five degree hub 60 or other hubs of the present invention, electricity is capable of traveling from each hub through the connecting arms 15 to other hubs throughout the arrangement.

FIG. 12A shows an alternative hub of the present invention, a forty-five degree power hub 70. The construction of the forty-five degree power hub 70 is similar to the forty-five degree hub 60. However, the construction allows electrical current to travel from a power source above the canopy 5 through a first power cord 43 and a second power cord 42 and into the hub 70. The first power cord 43 and second power cord 42 enter the hub 70 through two openings formed in the top of the forty-five degree hub 70 when first and second body components 64A, 64B are mated together.

Figure 12B:
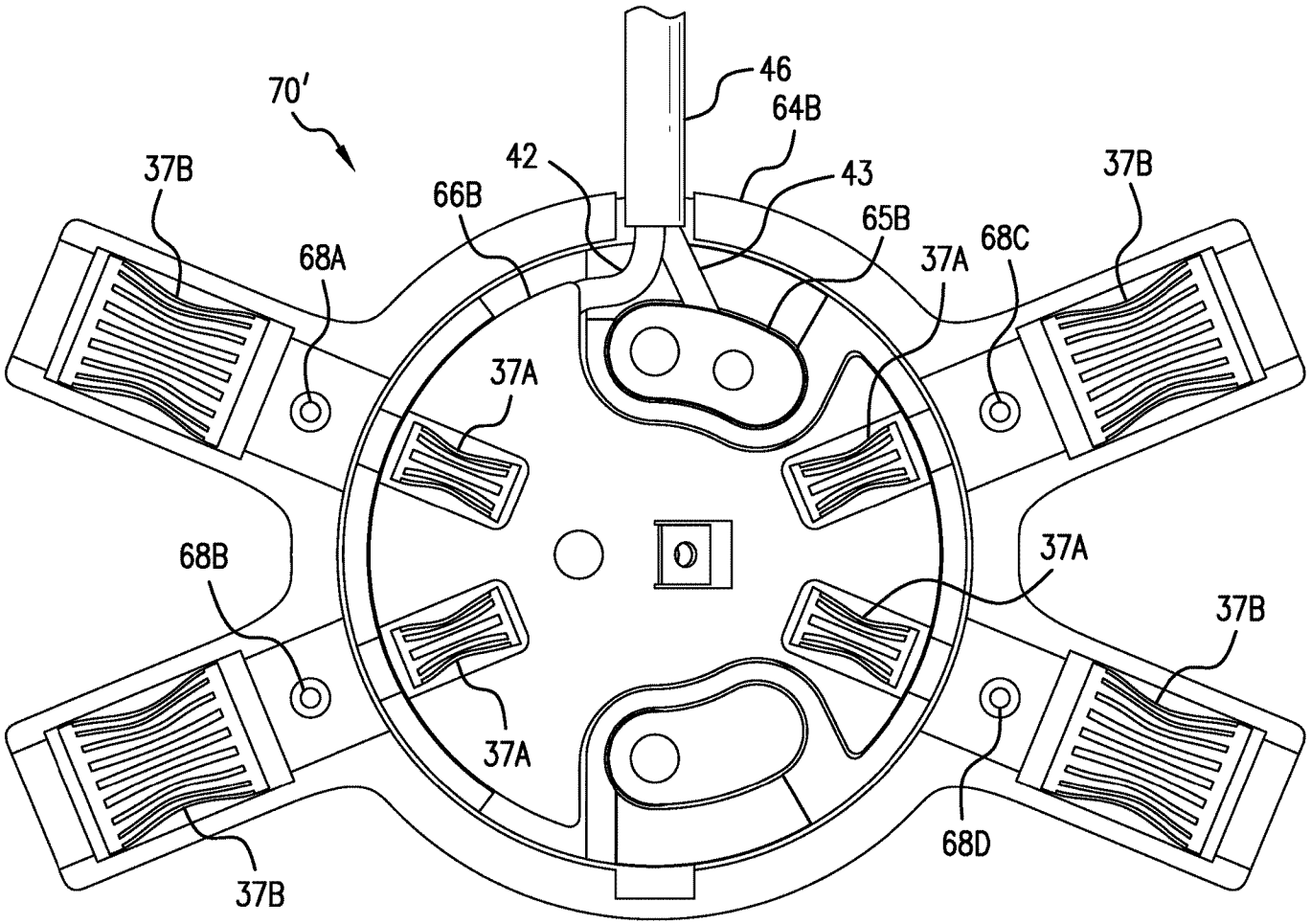
FIG. 12B is an enlarged side cross-sectional view of an alternative forty-five degree power hub of the present invention.
Figure 13A:
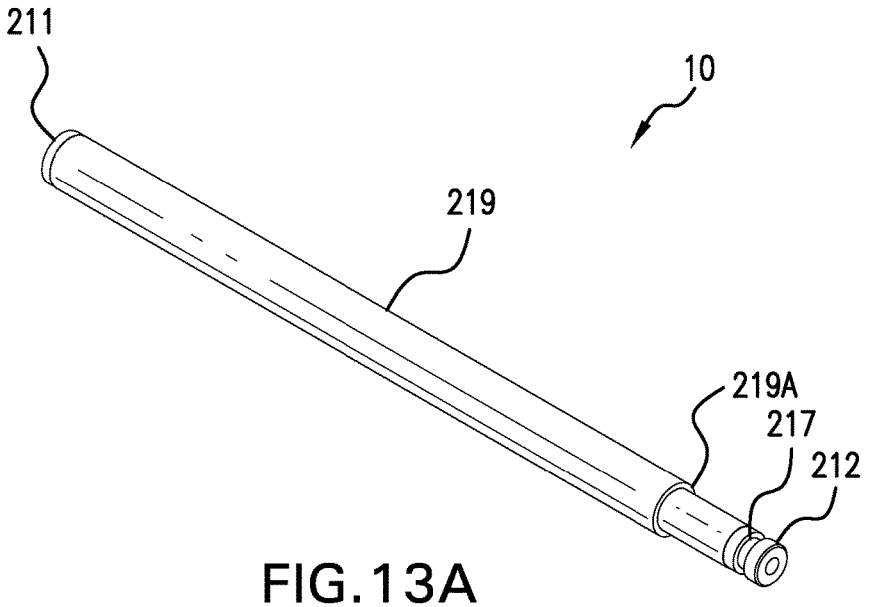
FIG. 13A is a perspective view of an end arm of the present invention.
Figure 13B:
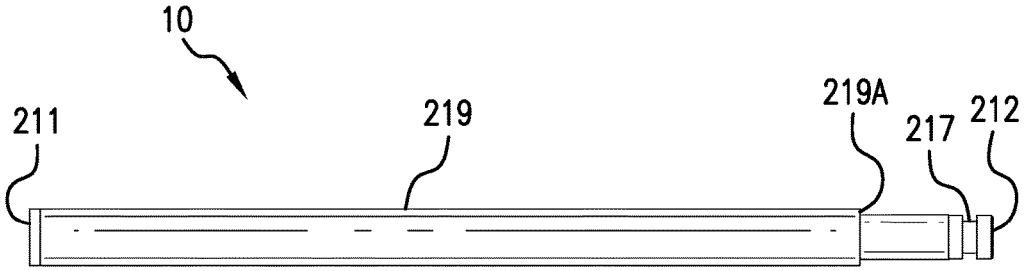
FIG. 13B is a top plan view of the end arm of the present invention.
Figure 13C:
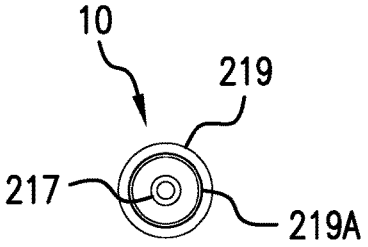
FIG. 13C is a right side elevational view of the end arm of the present invention.
Figure 13D:
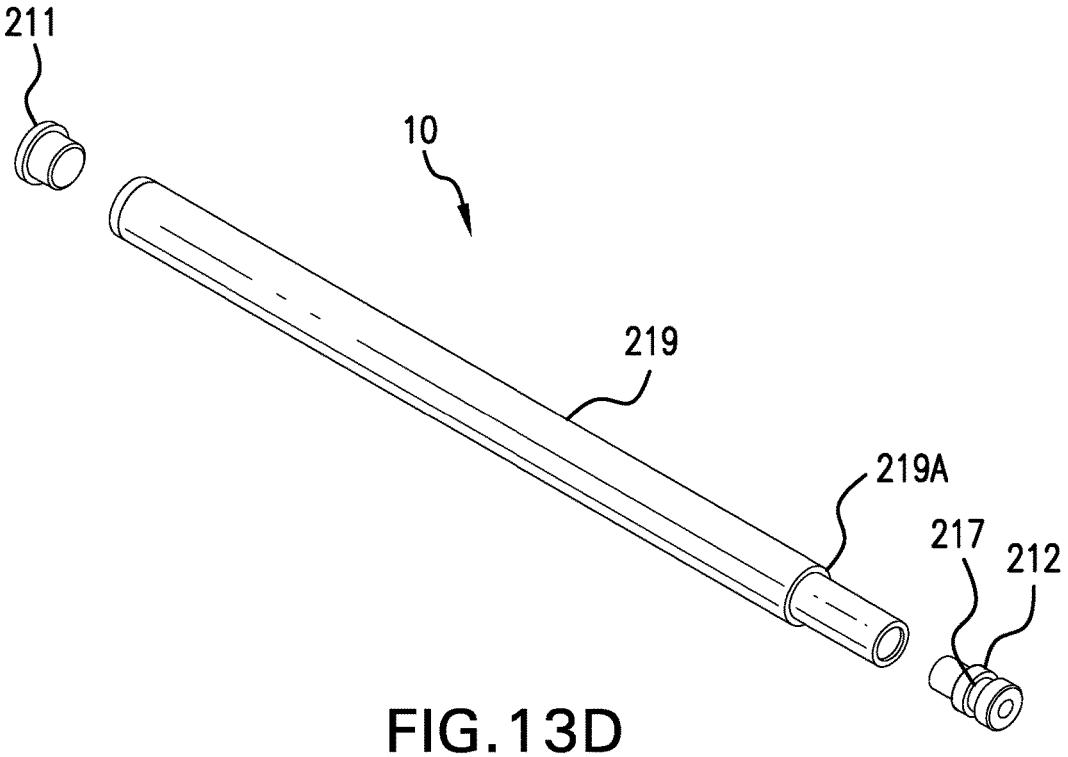
FIG. 13D is an exploded perspective view of the end arm of the present invention.
Figure 14C:
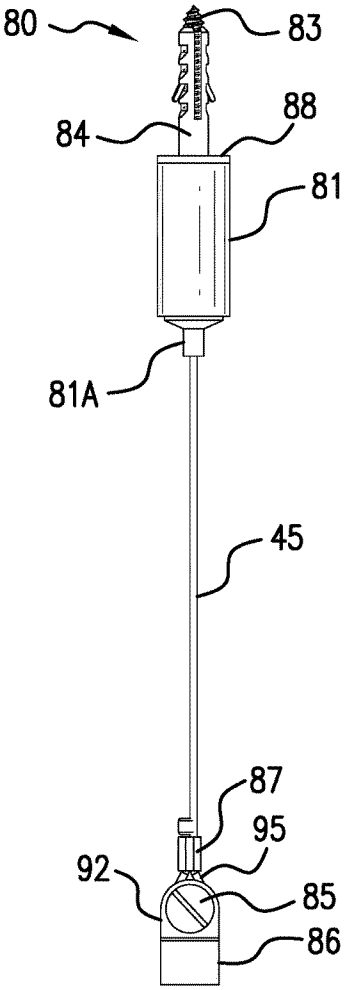
FIG. 14C is a front elevational view of the mount clip assembly of the present invention.
Figure 14B:
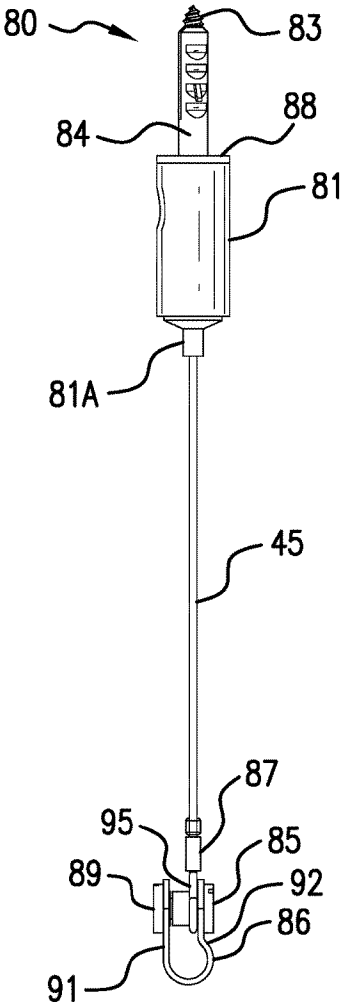
FIG. 14B is a right side elevational view of the mount clip assembly of the present invention.
Figure 14A:
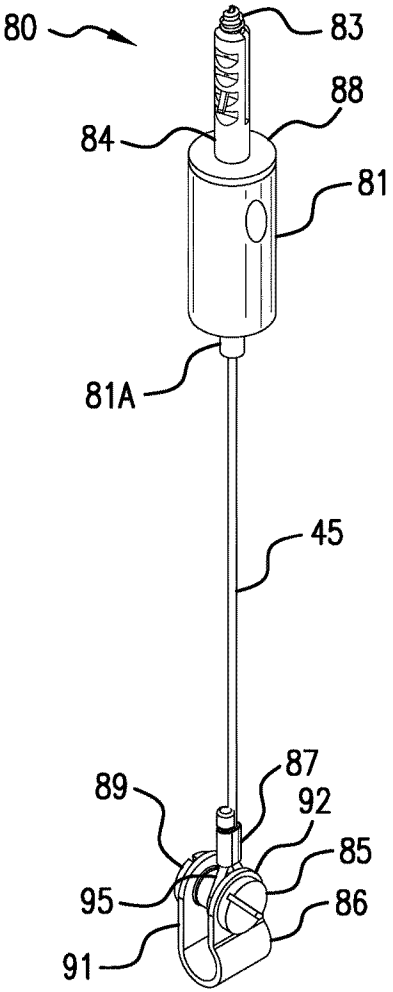
FIG. 14A is a perspective view of a mount clip assembly of the present invention.
Figure 14D:
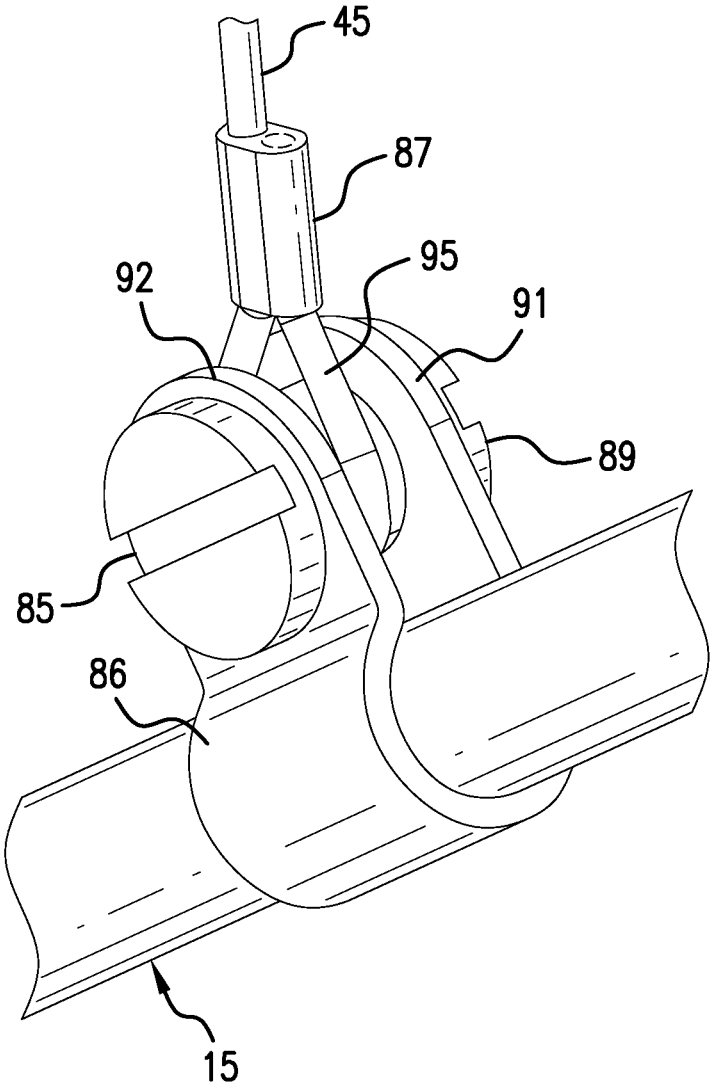
FIG. 14D is an enlarged perspective view of a section of the mount clip assembly supporting a connecting arm of the present invention.

FIG. 12B shows an alternative forty-five degree power hub 70' of the present invention. Alternative forty-five degree power hub 70' has the same construction of hub 70 except that it allows electrical current to travel from a power source and enter the hub 70' through one central opening formed in the top of the forty-five degree hub 70' when the first and second body components are mated together.

As shown in FIG. 12B, the first power cord 43 supplies negative (−) current to the forty-five degree power hub 70'. The first power cord 43 enters the top of the forty-five degree hub 70' and connects to the first insulator 65B to make an electrical connection with the first and second body components 64A (as shown in FIG. 10B), 64B of the forty-five degree hub 70'. The second power input cord 42 supplies positive (+) current to the forty-five degree power hub 70'. The second power input cord 42 enters the top of the forty-five degree power hub 70' and connects to the first and second conductor plates 66A (as shown in FIG. 10B), 66B to make an electrical connection with the forty-five degree power hub 70'. The first and second power cords 42, 43 can be enclosed in a sleeve 46. Once the first and second power input cords 43, 42 are connected to a power supply, electricity travels into the forty-five degree power hub 70' and illuminates the lights 63 in the first and second light sources 63A, 63B (as shown in FIG. 10B). Additional hubs, such as the linear hub 30 or the forty-five degree hub, can be added to the lighting system arrangement by attaching additional connecting arms 15. Once installed, the forty-five degree power hub 70' will supply current through the connecting arms 15 to the additional hubs in order to illuminate the light sources 63A, 63B therein.

Any power hub, such as the linear power hub 50, the forty-five degree power hub 70, or the alternative forty-five degree power hub 70' have to be installed to a power supply. FIG. 17 shows the installation of the alternative forty-five degree power hub 70'. The power cords 42, 43 are installed through a bushing 71 and then extend through the canopy 5. The power cords 42, 43 are adjusted to the desired length and secured with a slotted set screw 71*a*. A mounting plate 24 is attached to an outlet mounting box 25 using outlet box screws 24*a*. Electrical connections are secured by connecting the positive low voltage wire 42*a* from the power supply 27 to the positive power cord 42 and then connecting the negative low voltage wire 43*a* from the power supply 27 to the negative power cord 43. The connections are all placed in and through the outlet box 25. The canopy 5 is then secured to the mounting plate with set screws 5*a*.

The forty-five degree power hub 70, 70' or the linear power hub 50 is used in the lighting system of the present invention to provide electrical current to the entire arrangement of the lighting system. Any power hub 50, 70, 70' or the like, may be utilized to obtain a desired configuration or arrangement of the lighting system. The arrangement 100A shown in FIG. 1 utilizes the forty-five degree power hub 70' to provide electricity to all the components in the lighting system. By way of example, the arrangement 100B shown in FIG. 2 utilizes the linear power hub 50 to provide electricity to all components in the lighting system.

An alternative connecting arm, namely an end arm 10, is shown in FIGS. 13A-13D. The end arm 10 is used to cap off any hub of the lighting system including the linear hub 30, forty-five degree hub 60, linear power hub 50, forty-five degree power hub 70 or alternative forty-five degree power hub 70'.

As is shown, the end arm 10 comprises an arm body 219, an arm cap 211 and an insulated mount 212. The arm body 219 has an elongated body having a first end and a second end. The first end of the arm body 219 is capable of accepting the arm cap 211 therein. The second end of the arm body 219 may have a shoulder section 219A having a smaller diameter than the diameter of the arm body 219. The second end of the arm body 219 is sized to accept the insulted mount 212 therein. The insulted mount 212 comprises an annular aperture or slot 217 capable of accepting and receiving a set screw 38A, 38B, 67 of a hub unit (such as shown in FIGS. 5E and 10B) in order to connect the end arm 10 to an arm mount of a hub of the present invention. The arm cap 211 and the insulated mount 212 may be connected to the arm body 219 by any means known by those skilled in the art, such as a screw fit, snap fit, glue or groove system.

The arm body 219 may be made from metal, plastic or other material. In the preferred embodiment, the arm cap 211 and the insulated mount 212 are made of insulating material. The end arm 10 mechanically connects to the any of the hubs of the present invention by inserting the insulated mount 212 into an arm mount of any hub of the present invention. The end arm 10 can vary in length. In one embodiment of the present invention, the end arm may be 2½", 3¼", etc. In the preferred embodiment, the end arm 15 is cylindrical. It is contemplated that the end arm may have various cross-sectional shapes such as rectangular, square or other polygons.

FIGS. 14A-14D show the mount clip assembly 80 of the present invention. The mount clip assembly 80 is capable of attaching to the canopy 5, ceiling or similar support structure to provide additional support for the lighting system and to secure a connecting arm 15. The mount clip assembly 80 comprises an upper cable gripper component 81, lower cable gripper component 81*a*, screw 83, anchor 84, ceiling hanger 45, mount 87, cap 88, first screw post 85, second screw post 89 and rod holder 86. Screw 83 is inserted through the center of the cap 88 and then into the anchor 84. The ceiling hanger 45 has a first end and a second end, the first end is inserted in the lower cable gripper component 81*a* and then extends into the upper cable gripper component 81. The cap 88, with the screw 83 and anchor 84 therein, is inserted in the upper cable gripper component 81. The second end of the ceiling hanger 45 bends around to form a loop 95 defining an internal area that is secured in place by the mount 87. The rod holder 86 contains two extending arms, 91, 92 each having a corresponding aperture 93, 94 (as shown in FIG. 15B) therein. To connect the mount clip assembly 80, the second screw post 89 is inserted through the first aperture 93 of the rod holder 86, through the internal area of loop 95 of the ceiling hanger 45. The first screw post 85 extends through the second aperture 94 of the rod holder 86, through the internal area of the loop 95 of the ceiling hanger 45 and mates with the second screw post 89. Rod holder 86 is pivotally rotatable about the second screw post 89. The loop 95 of the ceiling hanger 45 is rotatable about the second screw post 89. The second screw post 89 is preferably a screw having a head and a threaded body.

In install the mount clip assembly 80 onto a connecting arm 15, slide the connecting arm 15 through the rod holder 86. Once the connecting arm 15 is in the desired location, tighten the second screw post 89. The first screw post 85 may also be tightened. In an alternative embodiment, the first screw post 85 may be a cylindrical post that is internally threaded to accept second screw post 89 therein. In an additional alternative embodiment, the first screw post 85 may be a stay clip, grip clip or clamp.

As shown in FIG. 17, the mount clip assembly 80 may be installed to the canopy 5. When installed to the canopy 5, the upper cable gripper component 81 is built into the canopy 5 and sits above the canopy 5 while the lower cable gripper component 81*a* extends below the canopy 5. The first end of the ceiling hanger 45 is inserted into the lower cable gripper component 81*a* and pushed there-through until the amount of ceiling hanger 45 hanging below the lower cable gripper component 81*a* allows the mount clip assembly to hang at the desired height. To raise the mount clip assembly 80, the ceiling hanger 45 is shortened. To do so, the ceiling hanger 45 is pushed up into the lower cable gripper component 81*a* and then into the upper cable gripper component 81 and the ceiling hanger 45 locks within the upper cable gripper component 81 automatically. To lower the mount clip assembly 80 the ceiling hanger 45 is lengthened. To lower the mount clip assembly 80, the ceiling hanger 45 is first lifted up and the cable gripper 81 is pushed up. While the cable gripper 81 is depressed, the ceiling hanger 45 is lowered to the desired height and the cable gripper 81 is released.

Figure 15A:
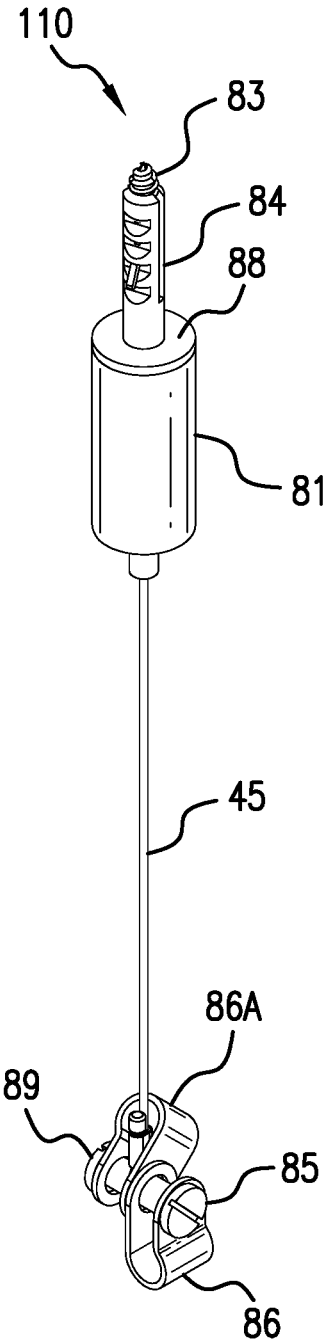
FIG. 15A is a perspective view of a double mount clip assembly of the present invention.
Figure 15B:
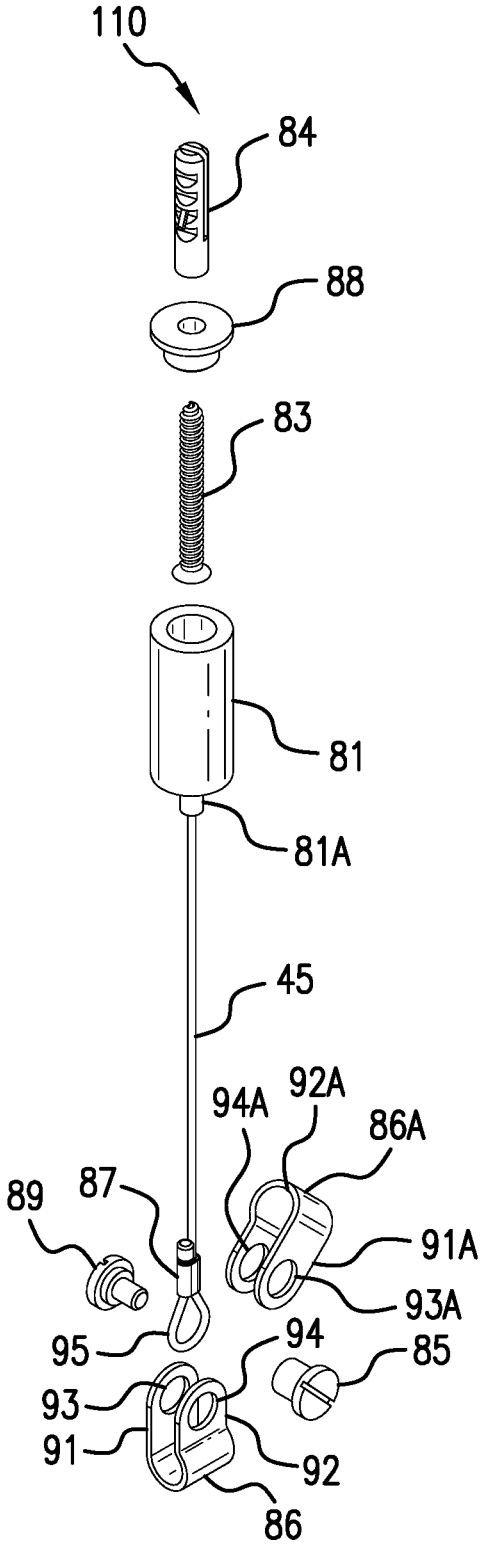
FIG. 15B is an exploded perspective view of the double mount clip assembly of the present invention.

FIGS. 15A-16B show an alternative double mount clip assembly 110 of the present invention. The double mount clip assembly 110 is capable of attaching to the canopy 5, ceiling or similar support structure to provide additional support for the lighting system and to secure two connecting arms 15. The double mount clip assembly 110 has a similar construction to the mount clip assembly 80 and further comprises a second rod holder 86A. As shown in FIGS. 15A and 15B, the double mount clip assembly 110 is connected similarly to the mount clip assembly 80. The rod holder 86 contains two extending arms 91, 92 each having a corresponding aperture 93, 94 therein. The first and second apertures 93, 94 are aligned. The second rod holder 86A contains two extending arms 91A, 92A, each having a corresponding aperture 93A, 94A therein. The first and second aperture 93A, 94A are aligned. The first screw post 85 and the second screw post 89 connect to join rod holder 86, the second rod holder 86A and the ceiling hanger 45. The first screw post 85 extends through the following elements respectively, the first aperture 94A, the internal area of loop 95 of the cable hanger 45, the second aperture 93A, the first aperture 93 and the second aperture 94. Once assembled, the rod holder 86 and the second rod holder 86B are separately pivotally rotatable around the first and second screw posts 89, 85. This allows the double mount clip assembly 110 to be used to achieve various configurations.

To install the double mount clip assembly 110 onto two connecting arms 15, slide the first connecting arm 15 through the rod holder 86, slide the second connecting arm 15 through the second rod holder 86A. Once the connecting arms 15 are in the desired location, tighten the first screw post 85 into the second screw post 89 by use of a wrench or similar tool. In an alternative embodiment the second screw post 89 may be a stay clip, post or nut.

Figure 15C:
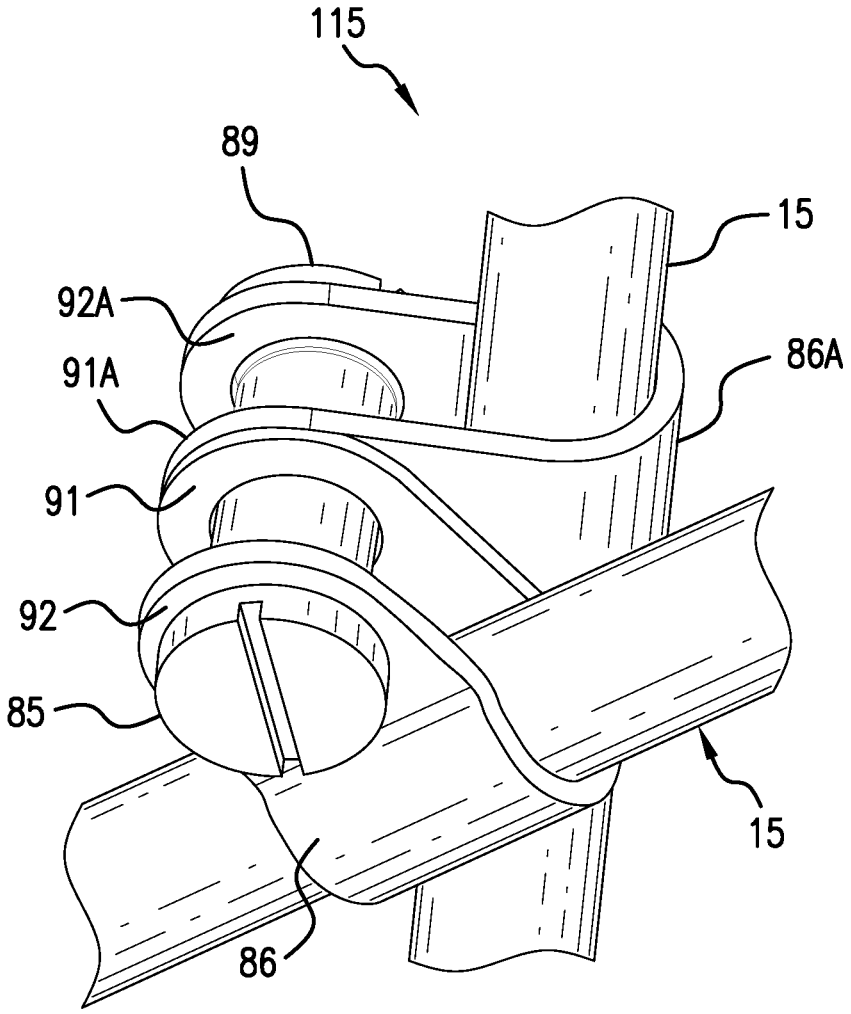
FIG. 15C is an enlarged perspective view of a section of the double mount clip assembly supporting a connecting arms of the present invention.
Figure 16A:
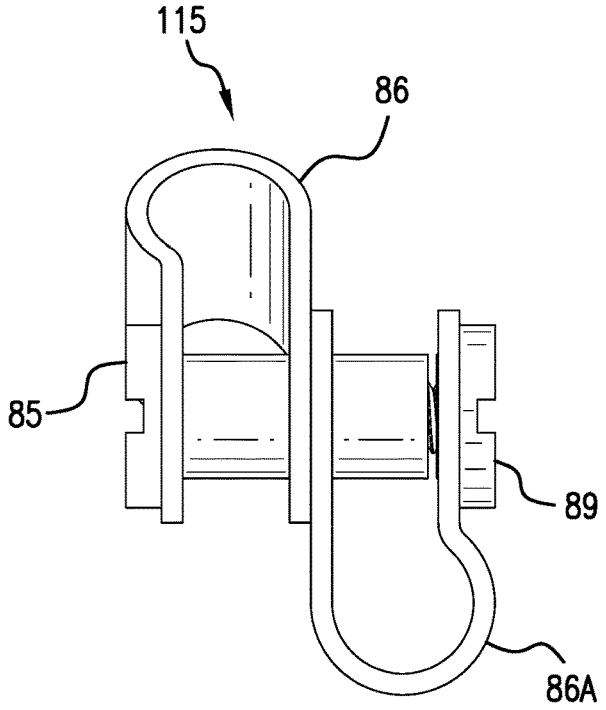
FIG. 16A is an enlarged side elevational view of the arm holder of the double mount clip assembly of the present invention.
Figure 16B:
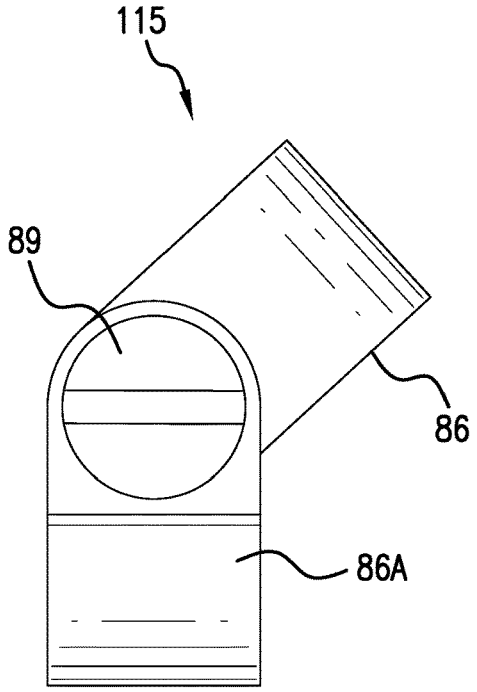
FIG. 16B is an enlarged front elevational view of the arm holder of the double mount clip assembly of the present invention.

In an alternative embodiment, the lighting system includes a double mount clip 115 as shown in FIGS. 15C, 16A and 16B, which has the same construction as the double mount clip assembly 110 but is not capable of mounting to the canopy 5 or ceiling so it lacks the upper cable gripper assembly 81, lower cable gripper assembly 81*a*, screw 83, anchor 84, ceiling hanger 45, mount 87, and cap 88. The double mount clip 115 attaches two connecting arms 15 without connecting to the canopy 5 or other support structure. The installation of the double mount clip 115 is the same as in the double mount clip assembly 110, however the second screw post 89 does not extend through the loop 95 of a ceiling hanger 45. As shown in FIGS. 1 and 2, the double mount clip 115 joins two connecting arms 15 in lighting system arrangements 100A and 100B.

The installation of the lighting system of the invention is shown in FIG. 17. It is similar to a typical instillation of a standard light fixture where the electrical components are connected to the electrical box via a high hat in the ceiling and covered by a canopy. In the installation of the lighting system power runs from a transformer (not shown). The transformer steps down the line voltage from a standard power line to 24 VAC or 12 VAC. The transformer's output wires are then installed to a LED driver in the power supply 27, which works to normalize the power and current needed to power the LEDs 63 of the first and second light sources 63A, 63B (as shown in FIG. 10B). The power supply 27 must be installed in a remote and accessible location near the lighting system arrangement, preferably above the ceiling near an opening. The power supply 27 output wires 42*a*, 43*a* are fed through an opening of the ceiling (not shown). The outlet box houses the wires 42*a*, 43*a* and a mounting plate 24 is secured to the outlet box 25 by screws 24*a*. As described herein, the wires 42*a*, 43*a* are then electrically connected to the wires of power cord 42, 43 of the lighting system arrangement. The wires 42, 43 of the lighting system are electrically connected to the forty-five degree power hub 70' or other power hubs depending on the arrangement to provide power as described herein.

Numerous modifications may be made to this invention without departing from its scope as defined in the appended claims.

What is claimed is:

1. A lighting system comprising:

a plurality of hubs including a power hub with at least one said hub including a light element for providing light when receiving an electrical current;

a power source for providing electrical power to said power hub; and a plurality of connecting arms for electrically and mechanically connecting said plurality of hubs to one another;

wherein said connecting arms and said hubs are interconnected in order to selectively conduct electrical current from said power source to said light element of said at least one hub, wherein a first hub includes a first arm mount for selectively receiving a first end of a first connecting arm and a second arm mount for selectively receiving a first end of a second connecting arm, wherein the first connecting arm includes an outer conducting body and an inner conducting rod nested in the outer conducting body, the inner conducting rod and the outer conducting body being electrically insulated from one another, wherein both of the inner conducting rod and the outer conducting body of the first connecting arm are electrically connected to a light element of the first hub for transmitting electrical current to the light element of the first hub.

2. The system of claim 1, wherein said plurality of hubs include at least one of a linear power hub and a forty-five degree power hub.

3. The system of claim 1, wherein the first hub includes a first conducting element which the inner conducting rod of the first connecting arm electrically contacts when the first end of the first connecting arm is received within the first arm mount of the first hub, and the first arm mount includes a conducting element which said outer conducting body of the first connecting arm electrically contacts when the first end of the first connecting arm is received within the first arm mount.

4. The system of claim 3, wherein said first conducting element of the first hub is electrically connected to a second conducting element of the first hub, and wherein said conducting element of said first arm mount is electrically connected to a conducting element of said second arm mount.

5. The system of claim 4, wherein said conducting element of the first arm mount comprises an annular spring, and an end portion of the outer conducting body of the first connecting arm is received within and electrically engages the annular spring of the first arm mount when the first end of the first connecting arm is received within the first arm mount.

6. The system of claim 5, wherein the first conducting element of the first hub comprises an annular spring located in longitudinal alignment with the annular spring of the first arm mount, and wherein said inner conducting rod of the first connecting arm includes an end portion which is received within and electrically engages the annular spring of the first hub when the first end of the first connecting arm is received within the first arm mount.

7. The system of claim 6, wherein the end portion of the inner conducting rod of the first connecting arm extends longitudinally past said end portion of said outer conducting body of the first connecting arm.

8. The system of claim 4, wherein said first conducting element of the first hub is electrically connected to said second conducting element of the first hub by means of at least one conducting plate disposed within the first hub.

9. The system of claim 8, wherein the first hub includes an electrically conductive outside body, and said conducting element of said first arm mount is electrically connected to the conducting element of said second arm mount by means of said outside body.

10. The system of claim 9, wherein said at least one conducting plate is electrically separated from said outside body by means of an insulating element.

11. The system of claim 1, wherein the first connecting arm has a circular cross-sectional shape, or a polygonal cross-sectional shape.

12. The system of claim 1, wherein the inner conducting rod of the first connecting arm has a circular cross-section, and the outer conducting body of the first connecting arm is annular.

13. A ceiling lighting system comprising:

a canopy disposed along the ceiling and a power source;

a power hub to which electrical power is provided from said power source through an electrical cable that runs through said canopy;

a plurality of additional hubs, said power hub and said additional hubs being electrically and mechanically interconnected to one another by a plurality of connecting arms; and at least one light element carried by at least some of said hubs and designed for providing light when receiving an electrical current;

wherein said connecting arms and said hubs are arranged so as to selectively conduct electrical current from said power source to said light elements; and wherein said connecting arms and said hubs of said system are supported from the ceiling by one or more hangers extending from the canopy and are configurable into a plurality of different mechanical arrangements, wherein a first hub includes a first arm mount for selectively receiving a first end of a first connecting arm and a second arm mount for selectively receiving a first end of a second connecting arm, wherein the first connecting arm includes an outer conducting body and an inner conducting rod nested in the outer conducting body, the inner conducting rod and the outer conducting body being electrically insulated from one another, wherein the inner conducting rod and outer conducting body of the first connecting arm are electrically connected to at least one light element of the first hub for providing electrical current to the at least one light element of the first hub.

14. The system of claim 13, wherein each said light element includes one or more lights as well as an overlying diffuser which encloses over said one or more lights.

15. The system of claim 13, wherein the first hub includes a first conducting element which the inner conducting rod of the first connecting arm electrically contacts when the first end of the first connecting arm is received within the first arm mount of the first hub, and the first arm mount includes a conducting element which said outer conducting body of the first connecting arm electrically contacts when the first end of the first connecting arm is received within the first arm mount; and wherein the first conducting element of the first hub is electrically connected to a second conducting element of the first hub, and wherein the conducting element of the first arm mount is electrically connected to a conducting element of the second arm mount.

16. The system of claim 15, wherein the conducting element of the first arm mount comprises an annular spring, and an end portion of the outer conducting body of the first connecting arm is received within and electrically engages the annular spring of the first arm mount when the first end of the first connecting arm is received within the first arm mount; and wherein the first conducting element of the first hub comprises an annular spring located in longitudinal alignment with the annular spring of the first arm mount, and wherein the inner conducting rod of the first connecting arm includes an end portion which is received within and electrically engages the annular spring of the first hub when the first end of the first connecting arm is received within the first arm mount.

17. The system of claim 16, wherein the first conducting element of the first hub is electrically connected to the second conducting element of the first hub by means of at least one conducting plate disposed within the first hub; and wherein the first hub includes an electrically conductive outside body, and the conducting element of the first arm mount is electrically connected to the conducting element of the second arm mount by means of said outside body.

18. The system of claim 16, wherein the end portion of the outer conducting body of the first connecting arm is annular.

19. The system of claim 13, wherein the inner conducting rod of the first connecting arm is longer than the outer conducting body of the first connecting arm.

20. A lighting system comprising:

a plurality of hubs including a power hub with each said hub including a light element for providing light when receiving an electrical current;

a power source for providing electrical power to said power hub; and a plurality of connecting arms for electrically and mechanically connecting said plurality of hubs to one another;

wherein said connecting arms and said hubs are interconnected in order to selectively conduct electrical current from said power source to said light elements;

wherein each connecting arm connects one hub to a second hub;

wherein each said hub includes a first depending arm mount for selectively receiving one end of a first connecting arm and a second depending arm mount for selectively receiving one end of a second connecting arm;

wherein each connecting arm includes an inner conducting rod and an annular outer conducting body;

wherein each connecting arm also includes an annular insulating member disposed between said inner conducting rod and said annular outer conducting body;

wherein said hub includes a first conducting element to which the inner conducting rod electrically contacts when one end of said connecting arm is received within said arm mount of said hub and each said arm mount includes a conducting element to which said annular outer conducting body electrically contacts when said one end of said connecting arm is received within said arm mount;

wherein said first conducting element of said hub is electrically connected to a second conducting element of said hub and wherein said conducting element of said first arm mount is electrically connected to the conducting element of said second arm mount; and wherein said conducting element of each said arm mount comprises an annular spring and said outer conducting body of said connecting arm includes an annular shoulder located at one end thereof which is received within and electrically engages said arm mount annular spring when one end of said connecting arm is received within said arm mount.

* * * * *